US005359949A

United States Patent [19]

Asano

[11] Patent Number: 5,359,949

[45] Date of Patent: Nov. 1, 1994

[54] SEWING SYSTEM HAVING FUNCTION TO STORE OPERATION-STATE DATA UPON DETECTION OF ABNORMALITY

[75] Inventor: Fumiaki Asano, Nagoya, Japan

[73] Assignee: Brother Kogyo Kabushiki Kaisha, Magoya, Japan

[21] Appl. No.: 59,952

[22] Filed: May 12, 1993

[30] Foreign Application Priority Data

May 18, 1992 [JP] Japan ..... 4-124549
Nov. 10, 1992 [JP] Japan ..... 4-299912

[51] Int. Cl.[5] ..... D05B 21/00

[52] U.S. Cl. ..... 112/121.12; 112/163; 112/278

[58] Field of Search ..... 112/121.12, 121.11, 112/273, 278, 275, 277, 155, 163, 164, 165, 166, 167, 220

[56] References Cited

U.S. PATENT DOCUMENTS 5,078,068 1/1992 Hager et al. ..... 112/273 X
5,184,560 2/1993 Asano ..... 112/273 X
5,228,403 7/1993 Sugimoto ..... 112/121.12

FOREIGN PATENT DOCUMENTS 62-57585 3/1987 Japan .
62-57588 3/1987 Japan .
2-91264 3/1990 Japan .

*Primary Examiner*—Peter Nerbun
*Attorney, Agent, or Firm*—Oliff & Berridge

[57] ABSTRACT

A sewing system including (A) a sewing device which includes (a) a sewing needle, (b) a first driver to reciprocate the needle, (c) a second driver to move the needle and a work sheet relative to each other in a direction crossing an axis line of the needle, and (d) a synchronizer to synchronize the reciprocation of the needle and the relative movement of the needle and work sheet, with each other, so as to form a series of stitches on the work sheet, (B) a detector associated with the sewing device to detect an abnormality of the sewing device, (C) a memory associated with the sewing device and the detector to store operation-state data indicative of an operation state of the sewing device upon detection of the abnormally, and (D) a utilizing device which utilizes the stored operation-state data for a control of the sewing system.

36 Claims, 24 Drawing Sheets

FIG. 5

| SEWING-HEAD NUMBER | NEEDLE-BAR NUMBER | TOTAL NUMBER OF THREAD BREAKAGES (TIMES) | THREAD-BREAKAGE FREQUENCY (TIMES/1,000 STITCHES) |
|---|---|---|---|
| 1 | 1 | 0 | 0 |
| | 2 | 1 | 0.1 |
| | 3 | 0 | 0 |
| | 4 | 1 | 0.2 |
| 2 | 1 | 5 | 7.2 |
| | 2 | 0 | 0 |
| | 3 | 1 | 0.3 |
| | 4 | 0 | 0 |
| 3 | 1 | 0 | 0 |
| | 2 | 1 | 0.1 |
| | 3 | 1 | 0.2 |
| | 4 | 0 | 0 |

FIG. 6

| MAXIMUM SEWING SPEED (MAX rpm) | THREAD-BREAKAGE FREQUENCY (TIMES/1,000 STITCHES) |
|---|---|
| 500 | 0.2 |
| 550 | 0.7 |
| 600 | 0.3 |
| ⋮ | ⋮ |
| 900 | 0.5 |
| 950 | 1.5 |
| 1000 | 1.6 |

FIG. 7

| STITCH LENGTH (mm) | THREAD-BREAKAGE FREQUENCY (TIMES/1,000 STITCHES) |
|---|---|
| 0.0~1.0 | 1.0 |
| 1.0~3.0 | 0.3 |
| 3.0~6.0 | 0.1 |
| 6.0~12.0 | 0 |

FIG. 8

| MAXIMUM SEWING SPEED (MAX mm) | STITCH LENGTH (mm) | ACTUAL SEWING SPEED (rpm) |
|---|---|---|
| 500 | 0 ~ 1.0 | 500 |
| | 1.0~ 3.0 | 500 |
| | 3.0~ 6.0 | 450 |
| | 6.0~12.0 | 400 |
| 550 | 0 ~ 1.0 | 500 |
| | 1.0~ 3.0 | 550 |
| | 3.0~ 6.0 | 500 |
| | 6.0~12.0 | 450 |

FIG. 9

| ACTUAL SEWING SPEED (rpm) | STITCH LENGTH (mm) | AVERAGE SEWING SPEED (rpm) |
|---|---|---|
| 500 | 0 ~ 1.0 | 430 |
| | 1.0~ 3.0 | 435 |
| | 3.0~ 6.0 | 480 |
| | 6.0~12.0 | 490 |
| 550 | 0 ~ 1.0 | 400 |
| | 1.0~ 3.0 | 500 |
| | 3.0~ 6.0 | 520 |
| | 6.0~12.0 | 550 |

FIG. 16

| MAXIMUM SEWING SPEED (MAX mm) | STITCH LENGTH (mm) | ACTUAL SEWING SPEED (rpm) |
|---|---|---|
| 500 | 0 ~ 1.0 | 500 |
| | 1.0~ 3.0 | 500 |
| | 3.0~ 6.0 | 450 |
| | 6.0~12.0 | 400 |
| 550 | 0 ~ 1.0 | 550 |
| | 1.0~ 3.0 | 550 |
| | 3.0~ 6.0 | 500 |
| | 6.0~12.0 | 450 |

FIG. 18

| OPERATION-TIME NUMBER | SEQUENTIAL NUMBER OF THREAD-BREAKAGE STITCH |
|---|---|
| 1 | 150, 2005, -1 |
| 2 | -1 |
| 3 | 150, -1 |
| ⋮ | ⋮ |
| 10 | 2005, -1 |
| -1 | -1 |

FIG. 21

| DIFFERENCE NUMBER (NO - NOx) | ROTATION AMOUNT OF MOTOR 250 |
|---|---|
| 0, 1 | TWO FULL REVERSE TURNS |
| 2 | ONE AND HALF REVERSE TURN |
| 3 | ONE FULL REVERSE TURN |
| 4 | HALF REVERSE TURN |
| ≧5 | QUARTER REVERSE TURN |

SEWING SYSTEM HAVING FUNCTION TO STORE OPERATION-STATE DATA UPON DETECTION OF ABNORMALITY

BACKGROUND OF THE INVENTION

1. Field of the Invention

The present invention generally relates to a sewing machine or system and particularly to such a sewing system which has the function to detect an abnormality of a sewing device thereof.

2. Related Art Statement

There is known a multiple-head embroidery sewing system having a plurality of sewing heads. The sewing system includes a control device which operates for reciprocating a needle bar or sewing needle provided in each sewing head while moving an embroidery frame supporting a work sheet in a plane defined by an X and a Y axis according to embroidery data indicative of stitch positions in the X-Y plane where the sewing needle penetrates the work sheet to form a series of stitches. Thus, the sewing system can concurrently produce a plurality of identical embroideries on the work sheet.

Each of Japanese Unexamined Patent Applications published under No. 62(1987)-57588, No. 62(1987)-57585 and No. 2(1990)-91264 discloses an example of the multiple-head embroidery sewing system. Each prior sewing machine has the function to calculate, before starting a sewing operation, a sewing time duration necessary to finish the sewing operation of forming a series of stitches as an embroidery. Based on the thus calculated or estimated sewing time duration, an operator can make his or her production plan. The control device of each sewing system automatically (a) determines an actual sewing speed (e.g., number of rotations per unit time of a main-shaft motor) at which to actually form each one of the series of stitches, based on (i) a length of each one stitch which is determined by utilizing embroidery data and (ii) a maximum sewing speed (i.e., upper limit of the rotation number of the main-shaft motor) which is set in advance by the operator, (b) calculates, based on the thus determined actual sewing speed, a time period necessary to form each one stitch, and (c) sums the time periods for all the stitches so as to determine the sewing time duration as a whole necessary to form the series of stitches as the embroidery.

In the above-indicated sewing system, however, a sewing thread supplied to the needle bar or sewing needle often breaks during the sewing operation. The frequency of occurrence of thread breakage varies depending upon actual sewing speeds, lengths of stitches, or thicknesses (i.e., thickness values) of sewing threads. However, thread breakage itself will occur in any sewing machine. Additionally, in the event that a drive mechanism of the sewing machine suffers from maladjustment or a failure, the frequency of thread breakage increases.

In general, an embroidery sewing system has a thread-breakage sensor which detects a breakage of a sewing thread supplied to a sewing needle. When the thread-breakage sensor detects a thread breakage, the sewing system informs an operator of the occurrence of thread breakage, by causing a buzzer to sound an alarm. At the same time, the sewing system stops the sewing operation. After the operator attends to the sewing system for passing the broken thread through the eye of the needle and operates a 'restart' switch thereof, the sewing system resumes the normal sewing operation. The thread breakages result in deteriorating the quality of the embroidery produced, increasing the sewing time duration due to the lost time necessary to restore the sewing system from the thread breakages, and lowering the production efficiency of the sewing system.

However, in the above-indicated conventional manner of estimating the sewing time duration, the lost time necessary to restore the sewing system from one or more thread breakages is not taken into account. Therefore, if one or more thread breakages occur during a sewing operation to form a series of stitches, an actual sewing time duration necessary to form the series of stitches increases. Thus, in the conventional sewing-time-duration estimation method, the possibility of occurrence of thread breakage, or lost time necessary to restore the sewing system, is not taken into account. Thus, the sewing time duration estimated by the conventional method is not satisfactorily reliable.

In addition, the conventional sewing system only informs the operator of the occurrence of each thread breakage. Even if the cause of thread breakage is not essentially inevitable, for example, due to maladjustment of the drive mechanism of the sewing system or excessively high sewing speed which causes can easily be removed, the operator cannot understand that the sewing system is in such a situation. Consequently, thread breakages will occur again and again due to the same cause, thereby lowering the production efficiency of the sewing system.

Meanwhile, in the above-indicated conventional multiple-head embroidery sewing system, the operator may set, before starting a sewing operation, a desired tension of a sewing thread supplied to a needle bar or sewing needle in each sewing head, by turning a knob of a thread-tension adjusting device.

There are known other causes of the occurrence of thread breakage than the above-indicated maladjustment of the drive mechanism and excessively high sewing speed; such as the use of a sewing thread which easily breaks, maladjustment of mechanical parts of the sewing system, and excessively high thread tension. Two or more of those causes may combine to produce a thread breakage. In addition, the sewing thread may break due to a mere accidental cause, such as including a weak or defective portion of a low mechanical strength.

In the embroidery sewing system which forms a series of stitches according to embroidery data indicative of stitch positions where the sewing needle penetrates the work sheet, the manner of arrangement of the embroidery data may cause the embroidery frame to make an abrupt, complex movement at a certain timing or position, thereby excessively largely twisting the sewing thread. The sewing thread easily breaks at such timings or positions in the sequence of formation of the series of stitches. This is an intrinsic cause of the occurrence of thread breakage, and therefore the thread breakage will occur again and again at the same position in the sequence of formation of stitches.

SUMMARY OF THE INVENTION

It is therefore an object of the present invention to provide a sewing system which has the function to store operation-state data indicative of an operation state of a sewing device thereof upon detection of an abnormality of the sewing device such as a thread breakage, and utilizes the stored operation-state data for controlling the sewing system, thereby improving the production efficiency of the sewing system.

The above object has been achieved by the present invention which provides a sewing system comprising (A) a sewing device which includes (a) a sewing needle, (b) a first driver to reciprocate the needle, (c) a second driver to move the needle and a work sheet relative to each other in a direction crossing an axis line of the needle, and (d) a synchronizer to synchronize the reciprocation of the needle and the relative movement of the needle and work sheet, with each other, so as to form a series of stitches on the work sheet, (B) a detector associated with the sewing device to detect an abnormality of the sewing device, (C) a memory associated with the sewing device and the detector to store operation-state data indicative of an operation state of the sewing device upon detection of the abnormality, and (D) utilizing means for utilizing the stored operation-state data for control of the sewing system.

In the sewing system constructed as described above, the detector detects an abnormality of the sewing device, the memory stores operation-state data indicative of an operation state of the sewing device upon detection of the abnormality, and the utilizing means utilizes the stored operation-state data for a control of the sewing system, in particular the sewing device thereof. Thus, the present sewing system can effectively make use of the abnormality, such as thread breakage, for improving sewing efficiency regarding subsequent sewing operation.

According to a feature of the present invention, the detector detects the abnormality relating to a stitch-forming operation of the sewing device to form the series of stitches. The abnormality may relate to a sewing thread supplied to the sewing needle during the formation of the series of stitches. The detector may be a thread-breakage sensor which detects as the abnormality a breakage of the sewing thread.

According to another feature of the present invention, the memory stores, as the operation-state data, abnormality-frequency data indicative of a frequency of occurrence of the abnormality per unit operation amount of the sewing device. The unit operation amount may be either unit number of stitches or unit time of sewing operation.

According to yet another feature of the present invention, the sewing system further comprises informing means for providing an operator with a signal indicating that the frequency of occurrence of the abnormality is higher than a reference level. This situation may result from maladjustment of a drive mechanism which drives the sewing needle. The abnormality frequency may be calculated each time an abnormality is detected by the detector and, if the calculated frequency is higher than the preference level, the utilizing means may immediately utilize the data indicative of the calculated frequency for operating the informing means to inform the operator of that situation. In this case, the data indicative of the frequency are stored as the operation-state data in the memory. In response to this information, the operator may quickly take appropriate countermeasures such as re-adjustment of the drive mechanism for the sewing needle.

According to a further feature of the present invention, the sewing system further comprises modifying means for modifying a control condition, such as a sewing speed, of the sewing device so as to reduce the frequency of occurrence of the abnormality during formation of a second series of stitches after the formation of the series of stitches as a first series of stitches. Based on the abnormality-frequency data stored in the memory, it is possible to identify a sewing speed value at which the frequency is higher than a reference level. In such cases, the utilizing means may operate the modifying means so as to lower the sewing speed of the sewing device as the control condition thereof.

According to a further feature of the present invention, the sewing system further comprises estimating means for estimating a number of occurrence or occurrences of the abnormality during formation of a second series of stitches after the formation of the series of stitches as a first series of stitches, and estimating a sewing time duration necessary to form the second series of stitches such that the estimated sewing time duration includes the estimated number of recovery time period or periods each necessary to recover from the abnormality. Since the sewing time duration is estimated by taking into account the estimated number of recovery time period or periods, the sewing time duration is very reliable. The estimated sewing time duration may be indicated on a display device.

In a preferred embodiment of the present invention, the memory stores, as the operation-state data, operating-condition data indicative of at least one operating condition of the sewing device, each time the detector detects the abnormality during formation of the series of stitches, and thereby stores an accumulation of the operating-condition data for the series of stitches. In this case, the memory may store the operating-condition data each time the detector detects the abnormality during formation of a second series of stitches after the formation of the series of stitches as a first series of stitches, thereby storing an accumulation of the operating-condition data for the second series of stitches, and adding the accumulated operating-condition data for the second series of stitches to the accumulated operating-condition data for the first series of stitches. The memory may be an erasable and programmable read only memory, i.e., EPROM.

In the above-indicated preferred embodiment, the sewing device may comprise a plurality of sewing needles ordered in a predetermined sequence, and the at least one operating condition of the sewing device may comprise a location in the predetermined sequence of one of the sewing needles which is being used upon detection of the abnormality. In this case, the sewing device may form the series of stitches according to a plurality of stitch instructions each of which designates a corresponding one of the sewing needles.

In the above-indicated preferred embodiment, the sewing device may comprise a plurality of sewing needles ordered in a predetermined sequence, and the sewing system may further comprise input means for inputting data indicative of a thickness of a sewing thread supplied to each of the sewing needles. The at least one operating condition of the sewing device may comprise a thickness of the sewing thread supplied to one of the sewing needles which is being used upon detection of the abnormality.

In the above-indicated preferred embodiment, the sewing device may form the series of stitches according to a plurality of stitch instructions each of which represents a stitch position where the sewing needle penetrates the work sheet to form a corresponding one of the series of stitches, and the at least one operating condition of the sewing device may comprise a length of one of the series of stitches which is being formed upon detection of the abnormality.

In the above-indicated preferred embodiment, the sewing system may further comprise input means for inputting data indicative of an upper limit of a sewing speed of the sewing device to form the series of stitches, and the at least one operating condition of the sewing device may comprise the upper limit of the sewing speed for the series of stitches.

In the above-indicated preferred embodiment, the sewing system may further comprise input means for inputting data indicative of an upper limit of a sewing speed of the sewing device to form the series of stitches, and determining means for determining, based on the upper limit of the sewing speed and a length of each of the series of stitches, an actual sewing speed of the sewing device to form the each stitch, such that the actual sewing speed is not higher than the upper-limit sewing speed. The at least one operating condition of the sewing device may comprise an actual sewing speed of the sewing device to form one of the series of stitches which is being formed upon detection of the abnormality. In this case, the sewing system may further comprise modifying means for modifying, for reducing the frequency of occurrence of the abnormality during formation of a second series of stitches after the formation of the series of stitches as a first series of stitches, an actual sewing speed of the sewing device to form a first group of stitch or stitches out of the second series of stitches, such that the modified actual sewing speed for the first group is lower than the actual sewing speed determined for a second group of stitch or stitches out of the first series of stitches, the stitches in the first and second groups having respective lengths falling within a same range of stitch length.

In the above-indicated preferred embodiment, the sewing system may further comprise a counter which counts a number of occurrence or occurrences of the abnormality in association with each of the at least one operating condition of the sewing device.

In another embodiment of the present invention, the sewing device forms the series of stitches in a predetermined sequence, the memory storing, as the operation-state data, stitch-location data indicative of a location in the predetermined sequence of a particular or special one of the series of stitches which is being formed upon detection of the abnormality, the utilizing means utilizing the stitch-location data for modifying a control condition of the sewing device so as to form at least the special stitch under the modified control condition. The utilizing means may modify the control condition so as to reduce the frequency of occurrence of the abnormality such as thread breakage. Therefore, even in the case where the thread breakage occurs due to an intrinsic cause relating to the manner of arrangement of sewing data with respect to a particular stitch instruction thereof, the present sewing system can effectively avoid the thread breakage from occurring again and again in forming a special stitch according to the same, particular stitch instruction. Thus, the quality of the formed stitches is improved. In addition, since the modified control condition may be applied to only the special stitch and, optionally, some stitches preceding and/or following the special stitch in the predetermined sequence, the formation of the series of stitches as a whole is not adversely influenced. Thus, the sewing efficiency is not lowered.

In the above-indicated second embodiment, the detector may be a sensor which detects, as the abnormality, a breakage of a sewing thread supplied to the sewing needle.

In the above-indicated second embodiment, the memory may store the stitch-location data each time the detector detects the abnormality, the utilizing means judging whether the stored stitch-location data indicate that the sewing device is in a predetermined operation state for modifying the control condition of the sewing device, and utilizing, when a positive judgement is provided, the stored stitch-location data for modifying the control condition of the sewing device so as to form at least the special stitch under the modified control condition. The predetermined operation state may be identified when the detector has detected the abnormality a predetermined number of time or times which may be a single time, or two or more times.

In the above-indicated second embodiment, the utilizing means may utilize the stored stitch-location data for lowering a sewing speed of the sewing device as the control condition, to a first level so as to form at least the special stitch at the first sewing-speed level after the positive judgement is provided. The original sewing speed level may be lowered to the first level as a pre-fixed value, or lowered to the first level which is lower than the original level by a pre-fixed amount. In this case, when the abnormality does not occur in forming the special stitch at the first sewing-speed level after the positive judgement is provided, the utilizing means may raise the sewing speed of the sewing device to a second level higher than the first sewing-speed level. Thus, the thread-breakage frequency is effectively reduced, and at the same time the increasing of the sewing time duration due to the lowering of the sewing speed is minimized.

In the above-indicated second embodiment, the utilizing means may utilize the stored stitch-location data for lowering a tension of a sewing thread supplied to the sewing needle as the control condition, to a first level so as to form at least the special stitch at the first thread-tension level after the positive judgement is provided. In this case, the utilizing means may raise the tension of the sewing thread to a second level higher than the first thread-tension level when the abnormality does not occur in forming the special stitch at the first thread-tension level after the positive judgement is provided. Thus, the thread-breakage frequency is effectively reduced, and at the same time the unnecessary loosening of the sewing thread is minimized.

In the above-indicated second embodiment, the utilizing means may utilize the stored stitch-location data for modifying the control condition of the sewing device so as to form a first predetermined number of sequential stitches including the special stitch under the modified control condition after the positive judgement is provided. In this case, the sewing system may further comprise returning means for returning, upon detection of the abnormality, the sewing needle relative to the work sheet over a length corresponding to a second predetermined number of sequential stitches including the special stitch, the utilizing means modifying the control condition of the sewing device so as to form the first predetermined number of sequential stitches under the modified control condition after the returning of the sewing needle relative to the work sheet.

In yet another embodiment of the present invention, the sewing system further comprises a control device including the memory and the utilizing means, the control device being connected to the sewing device and the detector. The control device may be constituted by a personal computer including a central processing unit (CPU), a random access memory (RAM), and a read only memory (ROM).

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings, in which:

FIG. 5 is a view of a table representing sewing-head-classified thread breakage information stored in the EEPROM 17 of FIG. 3;

FIG. 6 is a view of a table representing maximum-sewing-speed-classified thread breakage information stored in the EEPROM 17 of FIG. 3;

FIG. 7 is a view of a table representing stitch-length-classified thread breakage information stored in the EEPROM 17 of FIG. 3;

FIG. 8 is a view of a table representing maximum-sewing-speed-classified and stitch-length-classified actual sewing speed information stored in the EEPROM 17 of FIG. 3;

FIG. 9 is a view of a table representing actual-sewing-speed-classified and stitch-length-classified average sewing speed information stored in the EEPROM 17 of FIG. 3;

FIG. 16 is a view corresponding to FIG. 8, showing a table representing maximum-sewing-speed-classified and stitch-length-classified actual sewing speed information stored in an EEPROM 107 of a control device 115 of the sewing system of FIG. 14;

FIG. 18 is a view of a table representing the content of a stitch-location data memory of a RAM 118 of the control device 115;

FIG. 21 is a view of a table showing the relationship between the difference numbers (NO−NOx) and the angular amounts of rotation of a thread-tension adjust motor 250 of the adjusting device 241 of FIG. 19;

DETAILED DESCRIPTION OF THE PREFERRED EMBODIMENTS

Figure 1A:
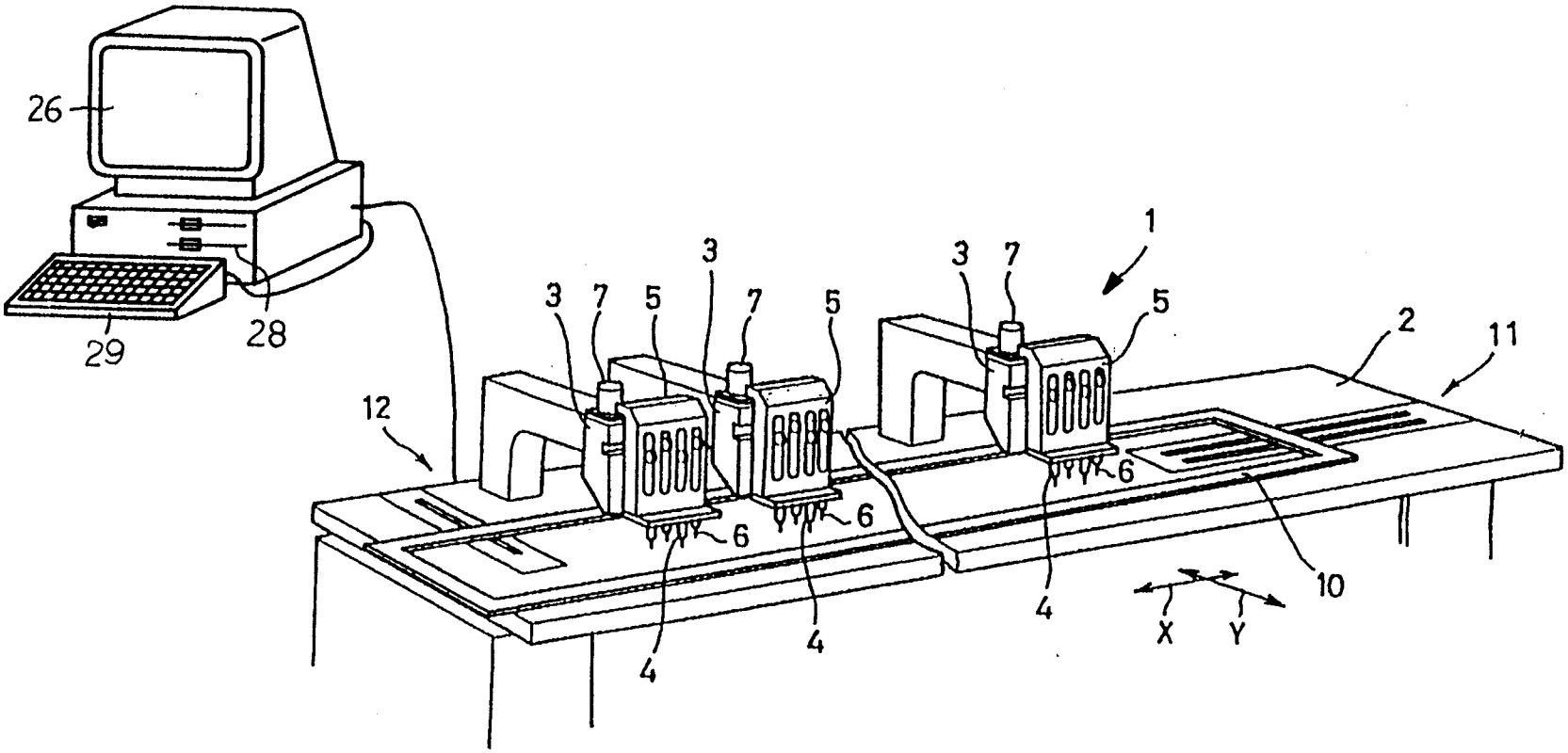
FIGS. 1A, 1B and 1C are a perspective view of a multiple-head embroidery sewing system as the first embodiment of the present invention.
Figure 2:
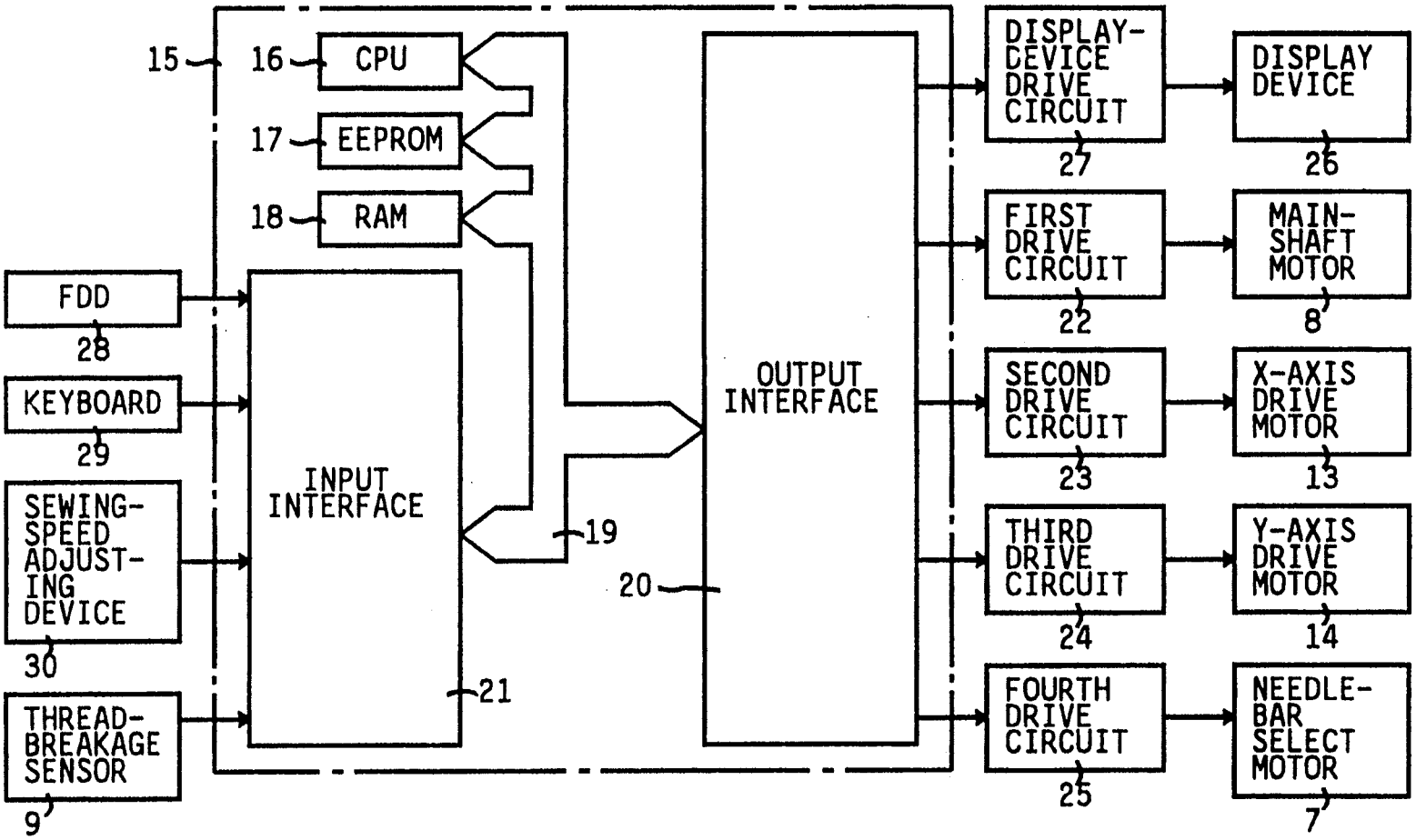
FIG. 2 is a diagrammatic view of the electric arrangement of the sewing system of FIG. 1.

Referring first to FIG. 1A, there is shown a multiple-head embroidery sewing system to which the present invention is applied. The electric arrangement of the sewing machine is shown in FIG. 2.

In FIG. 1A, reference numeral 1 designates a sewing device. The sewing device 1 includes a plurality of sewing heads 3 (three heads 3 are shown in the figure) which are supported on a support table 2, equidistantly from each other in a longitudinal direction of the table 2, i.e., along an X axis indicated at arrow. Each of the sewing heads 3 has a support case 5 which supports a plurality of needle bars 4 (four bars 4 are employed in the present embodiment). The four needle bars 4 of each sewing head 3 are arranged in the support case 5 along the X axis, and are supported by the case 5 such that each of the needle bars 4 vertically reciprocates. A sewing needle 6 is attached to the lower end of each needle bar 4. Embroidery threads of different sorts (colors, thickness values, etc.) are supplied from thread supply devices (not shown) to respective sewing needles 6 attached to the needle bars 4 in each sewing head 3.

The support case 5 of each sewing head 3 is driven by a needle-bar select motor 7, so that the case 5 displaces along the X axis. Each sewing head 3 includes a drive mechanism (not shown) which converts the rotation of a main shaft (not shown), which is driven at a variable rotation speed by a main-shaft motor 8 (FIG. 2), into the vertical reciprocation of an operative one of the four needle bars 4 which is currently indexed at an operative position in each sewing head 3 by the needle-bar select motor 7. In the present embodiment, the sewing heads 3 are identifiable from each other by sequential numbers, 1, 2, 3, . . . , which are assigned to the respective heads 3 starting with the left-hand end one 3 and ending with the right-hand end one 3 in FIG. 1A. Similarly, the four needle bars 4 in each sewing head 3 are identifiable from each other by sequential numbers, 1, 2, 3, and 4, which are assigned to the respective bars 4 starting with the left-hand end one 4 and ending with the right-hand end one 4 in FIG. 1A.

Figure 1B:
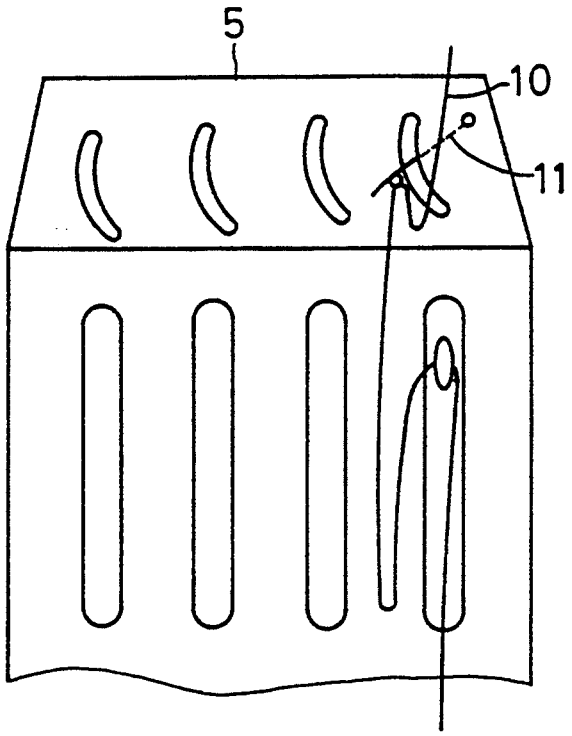
Figure 1C:
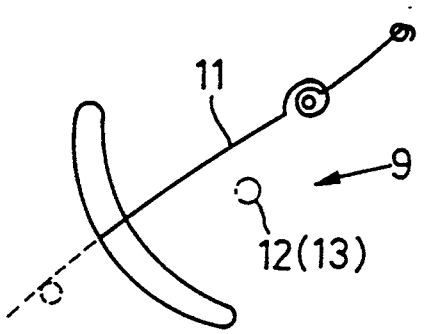

A thread-breakage sensor 9, as shown in FIGS. 1B and 1C, is provided in association with each of the needle bars 4 in each sewing head 3. The thread-breakage sensor 9 serves as a detector which detects an abnormality of the sewing device 1. Each thread-breakage sensor 9 senses the occurrence of an abnormal supply of an embroidery thread 10 to a corresponding sewing needle 6 due to a breakage of the thread, by detecting the stop of cyclic displacement of a thread take-up spring 11. The sensor 9 includes a light source 12 such as a light emitting diode (LED), and a light detector 13 which is opposed to the light source 12. When the thread 10 is normally supplied to the needle 6, the spring 11 is swung with the thread 10 so as to pass between the light source 12 and light detector 13 and thereby produce an electric pulse signal (i.e., detection signal) indicative of the normal thread supply. On the other hand, when the thread 10 is broken, the spring 11 is not swung, so that the light detector 13 does not produce any detection signal. Thus, a control device 15 (FIG. 2) identifies the occurrence of a breakage of the thread 10.

A loop-take mechanism (not shown) is provided, in association with each of the sewing heads 3, under the support table 2 so as to cooperate with the operative needle 6 in each sewing head 3 to form a series of stitches on a work sheet (not shown), such as a fabric or leather, which is held by a single, common embroidery frame 10. The embroidery frame 10 has a rectangular shape which is long along the X axis and short along a Y axis perpendicular to the X axis. Thus, the frame 10 can hold an elongate work sheet such that the work sheet extends below the sewing heads 3 along the X axis.

The embroidery frame 10 is adapted to be displaceable on the support table 2 in a horizontal plane defined by the X and Y axes, so that, when being driven by a frame drive mechanism, the frame 10 is movable to any position in the horizontal plane. The drive mechanism includes an X-axis drive device 11 which moves the frame 10 along the X axis, and a Y-axis drive device 12 which moves the frame 10 along the Y axis. The X-axis drive device 11 includes an X-axis drive motor (e.g., stepper motor) 13 (FIG. 2), while the Y-axis drive device 12 includes a Y-axis drive motor (i.e., stepper motor) 14 (FIG. 2).

The operations of the above-described motors 7, 8, 13, and 14 are controlled by the control device 15. The control device 15 is essentially constituted by a computer including a central processing unit (CPU) 16, an electrically erasable/programmable read only memory (EEPROM) 17, a random access memory (RAM) 18, and bus 19 which connects the components 16, 17, 18 to each other. The control device 15 includes an output interface 20 and an input interface 21 which are connected to the components 16, 17, 18 via the bus 19.

The present sewing system includes a first, a second, and a third drive circuit 22, 23, 24 which drives the main-shaft motor 8, X-axis drive motor 13, and Y-axis drive motor 14, respectively, and fourth drive circuits 25 to drive the respective needle-bar select motors 7 of the sewing heads 3. The first to fourth drive circuits 22 to 25 are connected to the output interface 20 of the control device 15. The sewing system further includes a display drive circuit 27 which drives a display device 26 such as a cathode ray tube (CRT). The display drive circuit 27 is also connected to the output interface 20.

In addition, the present sewing system includes a floppy disk drive (FDD) 28 through which the control device 15 reads embroidery data recorded on a floppy disk; a keyboard 29 through which an operator inputs various data to the control device 15; and a sewing-speed adjusting device 30 (FIG. 2) through which the operator inputs data indicative of an upper limit value of the sewing speed of the sewing device 1 (in the present embodiment, the sewing speed is defined as the number of rotations per minute of the main-shaft motor 8). The FDD 28, keyboard 29, and sewing-speed adjusting device 30, as well as the thread-breakage sensors 9, are connected to the input interface 21 of the control device 15. The control device 15, FDD 28, keyboard 29, and display device and drive circuit 26, 27 may be constituted by a personal computer as shown in FIG. 1A.

The control device 15 controls the operations of the main-shaft motor 8, the X-axis and Y-axis drive motors 13, 14, and the needle-bar select motors 7 of the sewing heads 3, according to control programs stored in the EEPROM 17 and the embroidery data (described in detail below) stored in the RAM 18, so as to automatically form a series of stitches, i.e., an embroidery on the work sheet held by the embroidery frame 10.

In the present embodiment, the embroidery data read from the FDD 28 and stored in the RAM 18, include a plurality of stitch instructions ordered in a predetermined sequence. Each stitch instruction specifies one of the four sewing needles 6 in each sewing head 3, by designating the sequential number assigned to that one needle 6, and represents a stitch position where the designated needle 6 penetrates the work sheet to form a stitch. Each stitch instruction represents a stitch position by specifying respective amounts of displacement of the embroidery frame 10 relative to the needle 6 along the X and Y axes, respectively, from the preceding stitch position where the preceding stitch is formed according to the preceding stitch instruction in the above-indicated predetermined sequence. Thus, each stitch instruction defines the length of a corresponding one stitch.

In the case where the first to fourth sewing needles 6 of each sewing head 3 are adapted to carry a red, a blue, a white, and a black embroidery thread, respectively, an embroidery is formed while those color threads are automatically changed with each other with regard to respective stitches of the embroidery. The embroidery data is read from the FDD 28 and is stored in the RAM 18, before the sewing device 1 starts the sewing or stitch-forming operation to form the series of stitches as the embroidery.

The present sewing system automatically performs the stitch-forming operation according to the embroidery data, on a software-control basis. The sewing system has the function (described in detail later) to store operation-state data indicative of an operation state of the sewing device 1, in the EEPROM 17 wherein the data stored therein are electrically changeable, and to utilize the stored operation-state data for controlling the sewing system itself. In particular, the control device 15 stores, as the operation-state data, an accumulation of operating-condition data indicative of one or more operating conditions of the sewing device 1. In the present embodiment, the EEPROM 17 serves as a memory which stores the operation-state data, and the control device 15 serves as utilizing means for utilizing the stored operation-state data for a control of the sewing system.

Figure 3:
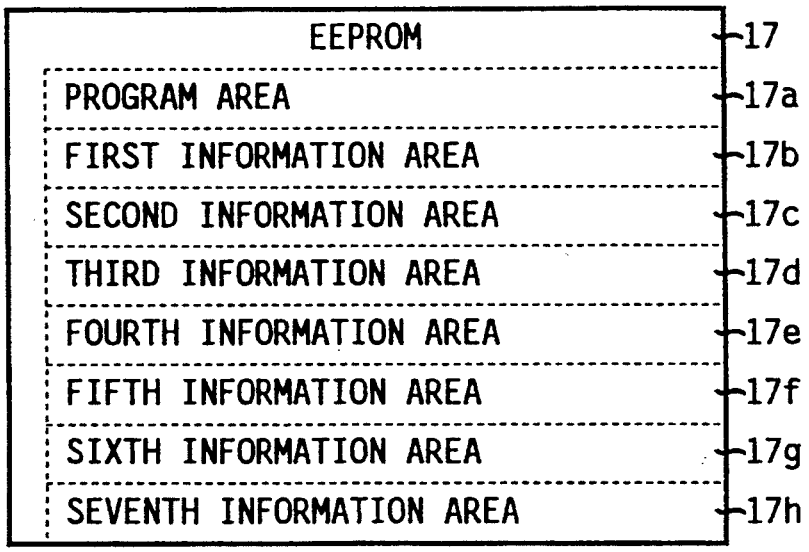
FIG. 3 is a diagrammatic view of an EEPROM 17 of a control device 15 of the sewing system of FIG. 1.
Figure 4:
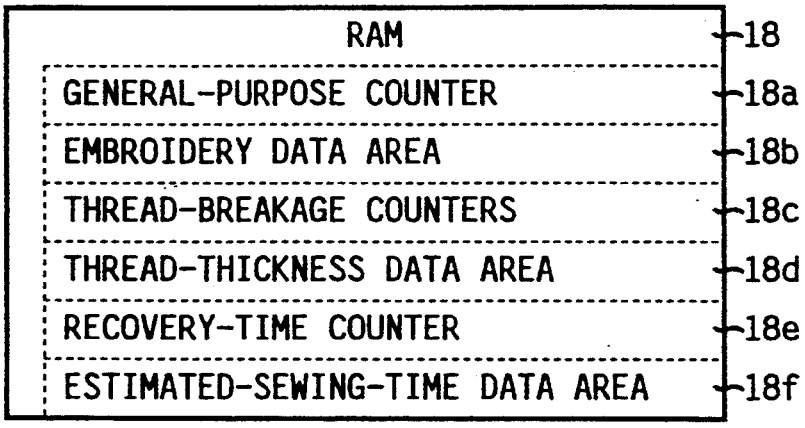
FIG. 4 is a diagrammatic view of a RAM 18 of the control device 15 of the sewing system of FIG. 1.

FIG. 3 is a diagrammatic view of the arrangement of the EEPROM 17. The EEPROM 17 includes a program area 17*a* which stores the control programs, and first to seventh information areas 17*b* through 17*h* as described below.

Specifically, the first information area, i.e., sewing-head/sewing-bar thread breakage information area 17*b* stores accumulated data indicative of a number of occurrence or occurrences of thread breakage with respect to each one of the four needle bars 4 (or sewing needles 6) in each of the sewing heads 3. FIG. 5 shows a table as an example of the accumulated data stored in the first information area 17*b*. The table shows that, for example, no thread breakage has occurred to the first needle bar 4 of the first sewing head 3 and one thread breakage has occurred to the second bar 4 of the first head 3. In addition, the first information area 17*b* stores accumulated data indicative of a total number of stitches which have been formed by each bar 4 of each head 3 (although not shown in FIG. 5), and accumulated data indicative of a frequency of occurrence of thread breakage per thousand stitches formed by each bar 4 of each head 3. The thread-breakage frequency is calculated by the control device 15 based on the total number of the stitches formed by each bar 4 (or needle 6). It can be estimated that maladjustment or failure has occurred to a particular needle bar 4 whose thread-breakage frequency is extremely high as compared with those of the other bars 4. For example, the first bar 4 of the second head 3 suffers from an extremely high thread-breakage frequency, as shown in FIG. 5.

The second information area, i.e., thread-thickness thread breakage information area 17*c* stores accumulated data indicative of a number of occurrence or occurrences of thread breakage with respect to each one of the different embroidery threads having different thread numbers representative of different thread thickness values, which threads are carried by the respective needles 6 in each head 3. The second information area 17*c* also stores accumulated data indicative of a frequency of occurrence of thread breakage per thousand stitches formed by using each one of the different sorts of threads, although no example of the data is shown.

The third information area, i.e., maximum-sewing-speed thread breakage information area 17*d* stores accumulated data indicative of a frequency of occurrence of thread breakage per thousand stitches formed at each one of the different upper-limit values of the sewing speed which are selectable by the operator through the sewing-speed adjusting device 30. FIG. 6 shows a table as an example of the data stored in the third information area 17*d*. In the present embodiment, the sewing-speed upper limit value, i.e., maximum rotation number per minute of the main-shaft motor 8 is selectable in steps of 50 rpm. The table of FIG. 6 shows that, for example, 0.2 times of thread breakage per thousand stitches have occurred at the maximum sewing speed of 500 rpm. The thread-breakage frequency is calculated by the control device 15 based on a total number of stitches formed at each one of the different maximum sewing speed values. To this end, the data stored in the seventh information area 17*h* (described in detail later) are utilized. From the table shown in FIG. 6, the operator can estimate in mind that the maximum sewing speed values should be selected at up to 900 rpm, for example. In general, at higher sewing speed values, the thread breakage occurs at a higher frequency.

The fourth information area, i.e., stitch-length thread breakage information area 17*e* stores accumulated data indicative of a frequency of occurrence of thread breakage per thousand stitches formed with stitch lengths falling within each one of different stitch-length ranges. FIG. 7 shows a table as an example of the data stored in the fourth information area 17*e*. In the present embodiment, the maximum stitch length is pre-determined at 12 mm, and the stitch lengths are classified into four stitch-length ranges. In general, when shorter stitches are formed, the thread breakage occurs at a higher frequency.

The fifth information area, i.e., maximum-sewing-speed/stitch-length actual sewing speed information area 17*f* stores accumulated data indicative of an adjusted sewing speed (hereinafter, referred to as "actual sewing speed") at which to actually form stitches falling within each one of the different stitch-length ranges, at each one of the different maximum sewing speed values. FIG. 8 shows a table as an example of the data stored in the fifth information area 17*f*. In general, the actual sewing speed values are lowered from the operator-selected maximum sewing speed value by greater amounts to form longer stitches. In addition, in the present embodiment, if the frequency of thread breakage is higher than a reference level predetermined in association with each of the operating conditions of the sewing device 1, the actual sewing speed values are automatically lowered in steps of 50 rpm so as to reduce the thread-breakage frequency.

The sixth information area, i.e., actual-sewing-speed/stitch-length average sewing speed information area 17*g* stores accumulated data indicative of a calculated average sewing speed at which the sewing device 1 would have formed stitches falling within each one of the different stitch-length ranges at each one of the different actual sewing speed values. FIG. 9 shows a table as an example of the data stored in the sixth information area 17*g*. The average sewing speed values are calculated by taking into account one or more recovery time periods each of which is necessary for the sewing device 1 to recover from a thread breakage and subsequently resume the normal stitch-forming operation. By using the data stored in the sixth information area 17*g*, the control device 15 estimates a sewing time duration necessary for the sewing device 1 to form another series of stitches according to embroidery data newly read from the FDD 28, such that the estimated sewing time duration includes one or more recovery time periods necessary to recover from one or more thread breakages which are estimated to occur during the formation of the new series of stitches.

The seventh information area, i.e., maximum-sewing-speed/stitch-length total stitch number count area 17*h* stores accumulated data indicative of a counted total number of stitches which have been formed with stitch lengths falling within each one of the different stitch-length ranges, at each one of the different maximum sewing speed values.

Meanwhile, the RAM 18 includes a general-purpose counter 18*a*; an embroidery data area 18*b* in which embroidery data is stored; various thread-breakage counters 18*c* each of which counts the number of occurrence or occurrences of thread breakage under a corresponding one of the operating conditions of the sewing device 1; a needle-bar thread thickness data area 18*d* which stores data indicative of a thread number of the thread carried by each sewing needle 6 (or needle bar 4) in each sewing head 3; a recovery-time counter 18*d* which measures a recovery time period necessary for the sewing device 1 to recover from a thread breakage; an estimated-sewing-time data area 18*f* which stores data indicative of an estimated sewing time duration.

The RAM 18 also includes a working area and a temporary area.

Hereinafter, there will be described the operation of the present sewing system constructed as described above, by reference to the flow charts of FIGS. 10, 11 (11A, 11B, 11C and 11D), 12, and 13. In the present embodiment, the control device 15 operates for control of the sewing system, according to the main routine of FIG. 10.

Upon application of electric power to the present sewing system, the control of the CPU 16 of the control device 15 begins with Step S1 to indicate, on the screen of the display device 26, a request to an operator to select one of (a) a stitch-forming operation routine, (b) a sewing-time-duration estimation routine, (c) a thread-breakage frequency indication routine, and (d) end or termination of the current operation.

When the operator selects (a) to perform the stitch-forming operation, the control of the CPU 16 proceeds with Step S2, i.e., stitch-forming operation routine. When the operator selects (b) to estimate the sewing-time duration, the control proceeds with Step S3, i.e., sewing-time-duration estimation routine. Meanwhile, when the operator selects (c) to indicate the thread-breakage frequency, the control proceeds with Step S4, i.e., thread-breakage-frequency indication routine. Each of the routines effected in Steps S2, S3 and S4 will be described in detail below.

First, the stitch-forming operation routine of Step S2 is explained by reference to the flow charts of FIGS. 11A through 11D which cooperate with each other to represent this routine.

Figure 11A:
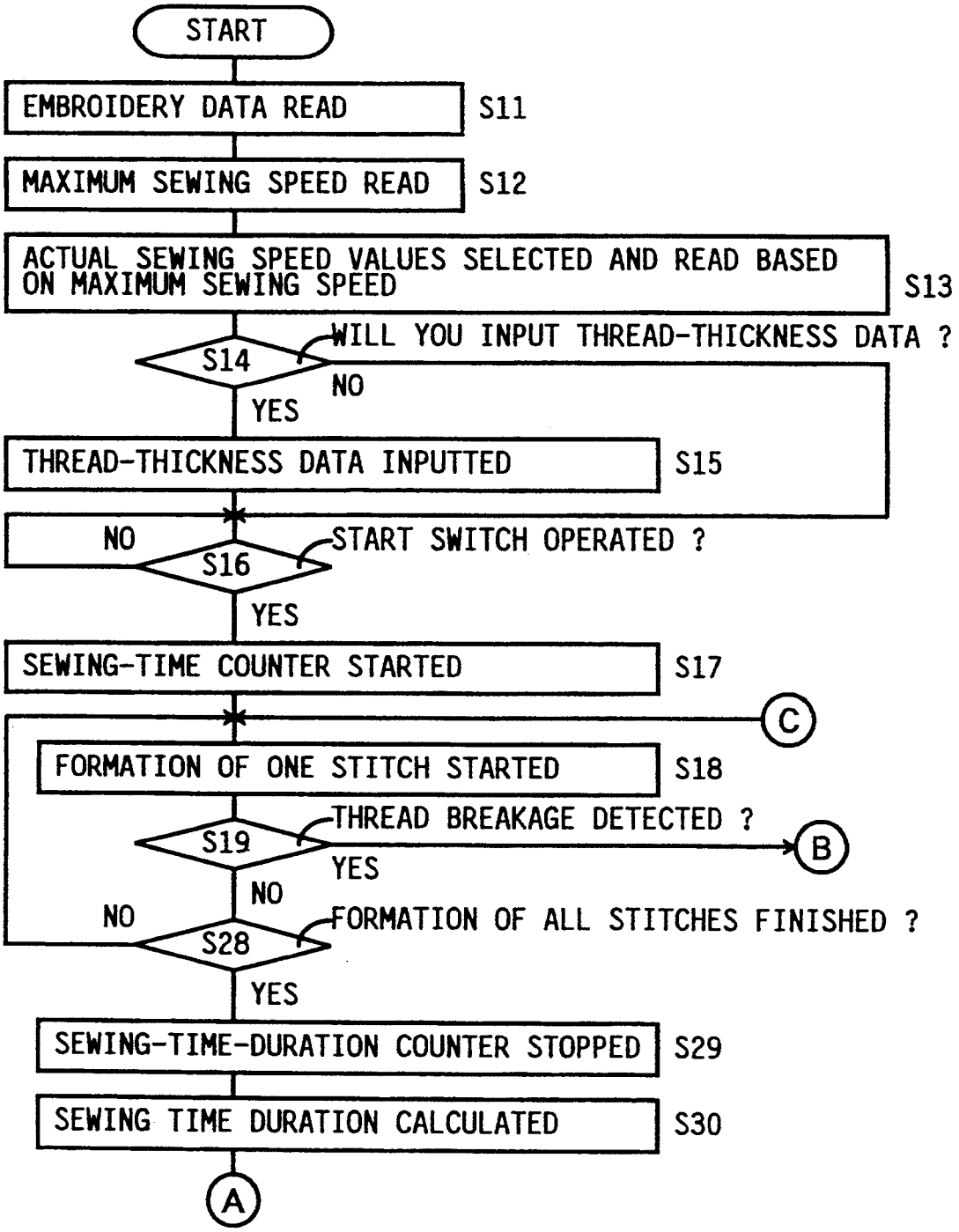
FIGS. 11A, 11B, 11C and 11D are respective portions of a flow chart representing a stitch-forming operation program as a sub-routine of the main routine of FIG. 10.
Figure 11B:
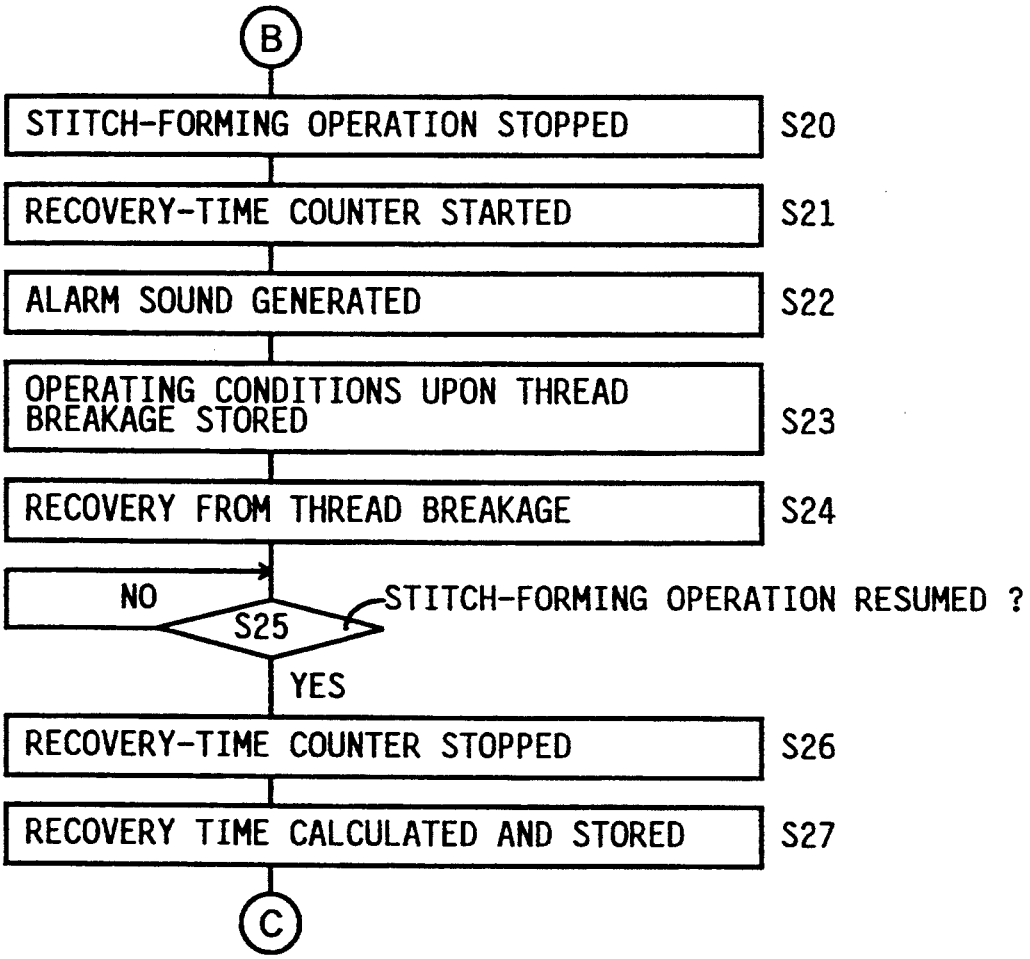

At Step S11 of FIG. 11A, the CPU 16 operates for reading, from the FDD 28, the embroidery data selected by the operator, and storing the data in the embroidery data area **18*b* of the RAM 18. At the following Step S12, the CPU 16 reads the upper-limit value of the sewing speed (i.e., maximum sewing speed) selected by the operator through the sewing-speed adjusting device 30. Step S12 is followed by Step S13 to read, from the fifth information area 17*f* of the EEPROM 17, the data indicative of an actual sewing speed to form stitches falling within each one of the different stitch-length ranges at the selected maximum sewing speed. The data stored in the fifth information area 17*f* is shown in FIG. 8. FIG. 8 shows that, in the event that the selected maximum sewing speed is 500 rpm, for example, the sewing device 1** is controlled to form stitches with not greater than 1.0 mm lengths at an actual sewing speed of 500 rpm; 1.0 to 3.0 mm long stitches at 500 rpm; 3.0 to 6.0 mm stitches at 450 rpm; and 6.0 to 12.0 mm stitches at 400 rpm.

Step S13 is followed by Step S14 to indicate, on the display device 26, a question to the operator as to whether the operator will input thread-thickness data indicative of a thread number of the thread supplied to each sewing needle 6 in each sewing head 3. A thread number represents the thickness of an embroidery thread. In the event that the thread-thickness data are used for the control of the sewing device 1, the operator inputs data indicative of "YES" through the keyboard 29, and the control of the CPU 16 goes to Step S15 at which the operator inputs the thread-thickness data through the keyboard 29. On the other hand, in the event that the thread-thickness data are not used, the operator inputs data indicative of "NO" and the control goes to Step S16 to judge whether or not a stitch-forming operation of the sewing device 1 has started, i.e., a 'start' switch on the keyboard 29 has been operated.

When a positive judgement is made in Step S16, the control goes to Step S17 to start a timer (i.e., general-purpose counter **18*a* of the RAM 18) to measure a sewing time duration of the current stitch-forming operation. At the following Step S18, the sewing device 1 is controlled to form one stitch at an actual sewing speed corresponding to a stitch length of that stitch, which sewing speed is specified according to the data read from the EEPROM 17 at Step S13. At Step S19, the control device 15 monitors whether or not any one of the thread-breakage sensors 9 has produced a detection signal indicating that the sensor 9 has detected the occurrence of a breakage of the thread supplied to the sewing needle 6 associated with that sensor 9, during the formation of the above one stitch at Step S18**.

When any one of the sensors 9 has detected a thread breakage, a positive judgement is made in Step S19. In this event, the control of the CPU 16 goes to Step S20 to stop all the stitch-forming operations in the sewing heads 3. Step S20 is followed by Step S21 to start the recovery-time counter **18*e* of the RAM 18 to measure a recovery time period necessary for the sewing device 1 to recover from the thread breakage. Step S21 is followed by Step S22 to actuate a buzzer (not shown) to issue an alarm sound informing the operator that a thread breakage has occurred to a particular needle 6, while indicating on the display device 26 the sequential number of the particular needle 6 and the sequential number of the particular sewing head 3 to which the particular needle 6** belongs.

Step S22 is followed by Step S23 to store, in the respective thread-breakage counters **18*c* of the RAM 18, respective sets of operating-condition data which are indicative of (a) the sequential number of the particular needle 6 and the sequential number of the particular head 3; (b) the thread number of the broken thread (only in the case where the thread-thickness data are stored in the data area 18*d* of the RAM 18**); (c) the stitch length of a particular stitch which is being formed upon detection of the thread breakage; and (d) the actual sewing speed at which the particular stitch is being formed.

At Step S24, in responding to the alarm sound, the operator attends to the sewing device 1 for restoring it from the thread breakage. Step S24 is followed by Step S25 to judge whether or not the sewing device 1 has been re-started by operating a 'restart' switch (not shown) on the keyboard 29 so as to resume the normal stitch-forming operation at the position where the thread breakage occurred. When a positive judgement is made in Step S25, the control of the CPU 16 goes to Step S26 to stop the recovery-time counter **18*e* from measuring the current recover time period. Step S26 is followed by Step S27 to calculate the recover time period based on the contents (i.e., counted number) of the counter 18*e*, and store data indicative of the calculated time period in the RAM 18. Then, the control of the CPU 16 goes back to Step S18** and the following steps.

When all the stitches have been formed according to the embroidery data read at Step S11, a positive judgement is made in Step S28. In this event, the control of the CPU 16 goes to Step S29 to stop the general-purpose counter **18*a* from measuring the current sewing time duration, and to Step S30 to calculate the sewing time duration based on the contents (i.e., counted number) of the counter 18***a*, and store data indicative of the calculated time duration in the RAM 18.

Figure 11C:
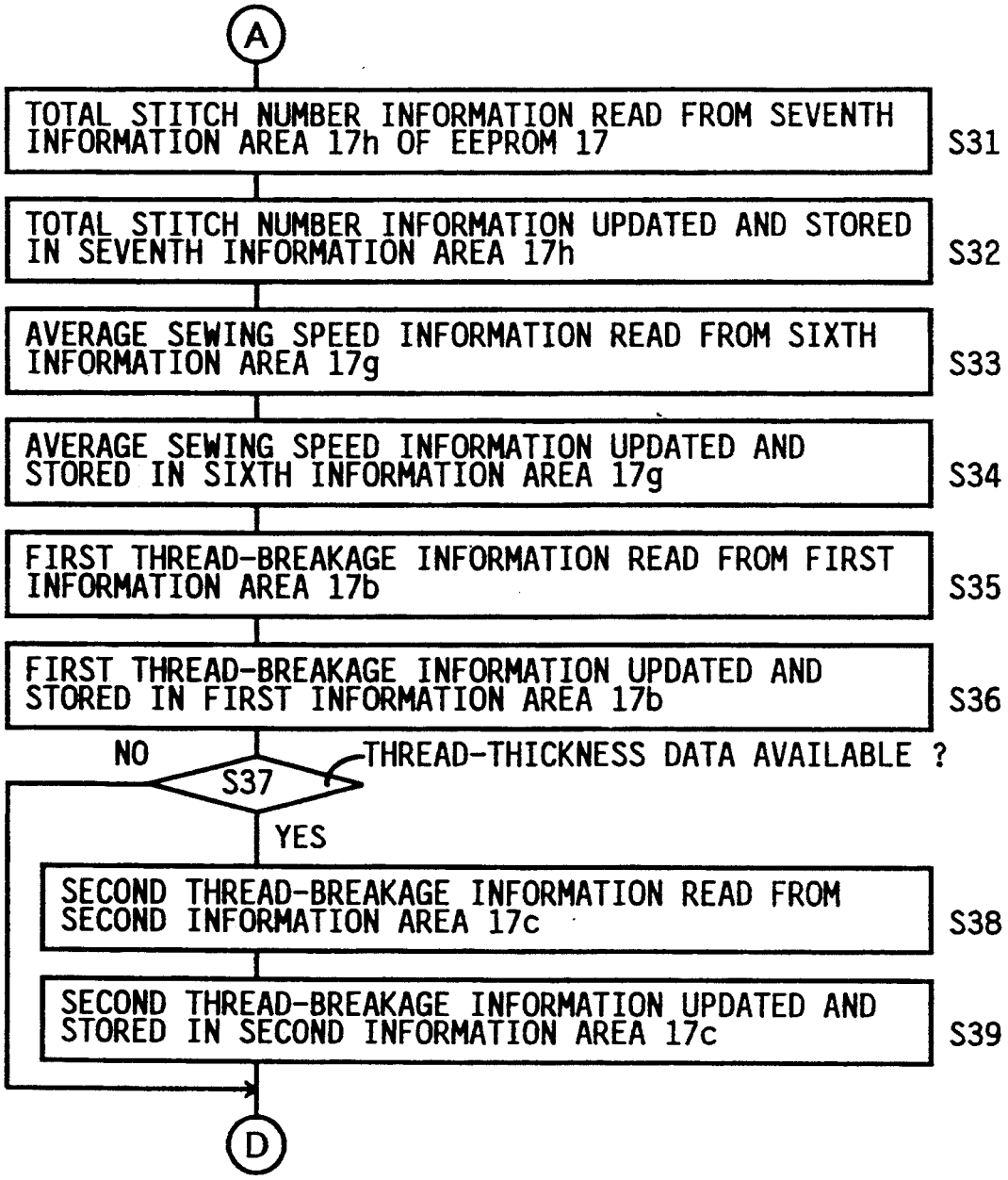
Figure 11D:
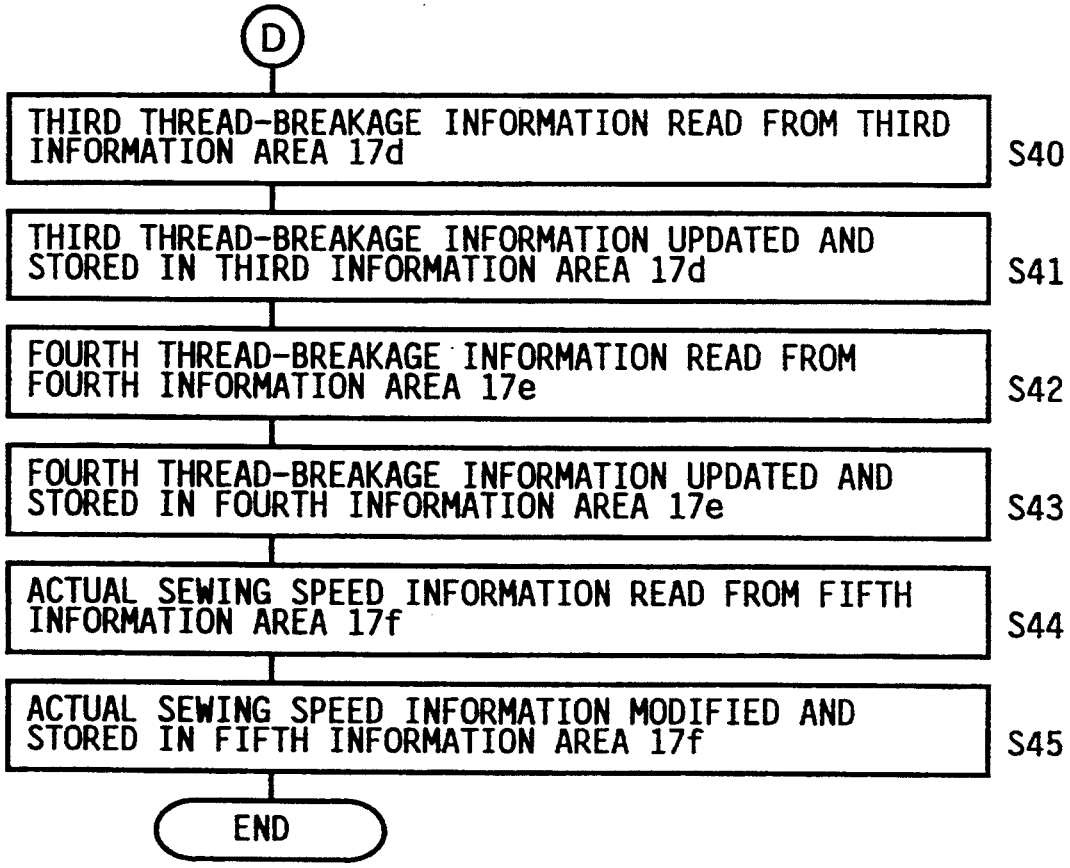

After the formation of the series of stitches have thus been finished, the operation-condition data stored in the RAM 18 upon detection of each thread breakage are added to the operation-condition data which have been accumulated in the EEPROM 17, at Steps 31 and the following steps of FIG. 11C, as follows:

At Step S31, the CPU 16 reads, from the seventh information area 17*h* of the EEPROM 17, the accumulated data indicative of maximum-sewing-speed-classified and stitch-length-classified total stitch numbers. Step S31 is followed by Step S32 to calculate, with regard to the stitches formed at the selected maximum sewing speed during the current stitch-forming operation, a number of stitches with respect to each one of the different stitch-length ranges, and modify the accumulated data stored in the fifth information area 17*f* by adding thereto new data indicative of the calculated stitch numbers.

Subsequently, in Step S33, the CPU 16 reads, from the sixth information area 17*g* of the EEPROM 17, the accumulated data indicative of actual-sewing-speed-classified and stitch-length-classified average sewing speed values as shown in FIG. 9. Step S33 is followed by Step S34 to calculate, based on the operation-condition data stored during the current operation, a thread-breakage frequency in association with each one of the different actual sewing speed values and each one of the different stitch-length ranges, and determine new average sewing speed values reflecting the thus determined thread-breakage frequency values. The data in the sixth information area 17*g* are updated with new data indicative of the new average sewing speed values.

Next, in Step S35, the CPU 16 reads, from the first information area 17*b* of the EEPROM 17, the accumulated data indicative of sewing-head-classified and sewing-bar-classified thread-breakage frequency values as shown in FIG. 5. Step S35 is followed by Step S36 to calculate, based on the thus read data and the operation-condition data stored during the current operation, a new thread-breakage frequency in association with each one of the different needle bars 6 of each one of the different sewing heads 3, and update the data in the first information area 17*b* with new data indicative of the new thread-breakage frequency values.

Subsequently, in Step S37, the CPU 16 judges whether or not the thread-thickness data have been inputted in Step S15 during the current operation. If a positive judgement is made in Step S37, the control of the CPU 16 goes to Step S38 to read, from the second information area 17*c* of the EEPROM 17, the accumulated data indicative of thread-thickness-classified thread breakage frequency values. Step S38 is followed by Step S39 to calculate, based on the thus read data and the operation-condition data stored during the current operation, a new thread-breakage frequency in association with each one of the different thread thickness values, and update the data in the second information area 17*c* with new data indicative of the new thread-breakage frequency values.

Subsequently, in Step S40, the CPU 16 reads, from the third information area 17*d* of the EEPROM 17, the accumulated data indicative of maximum-sewing-speed-classified thread breakage frequency values as shown in FIG. 6. Step S40 is followed by Step S41 to calculate, based on the thus read data and the operation-condition data stored during the current operation, a new thread-breakage frequency in association with each one of the different maximum sewing speed values, and update the data in the third information area 17*d* with new data indicative of the new thread-breakage frequency values.

Next, in Step S42, the CPU 16 reads, from the fourth information area 17*e* of the EEPROM 17, the accumulated data indicative of stitch-length-classified thread breakage frequency values as shown in FIG. 7. Step S42 is followed by Step S43 to calculate, based on the thus read data and the operation-condition data stored during the current operation, a new thread-breakage frequency in association with each one of the different stitch-length ranges, and update the data in the fourth information area 17*e* with new data indicative of the new thread-breakage frequency values.

Finally, in Step S44, the CPU 16 reads, from the fifth information area 17*f* of the EEPROM 17, the accumulated data indicative of maximum-sewing-speed-classified and stitch-length-classified actual sewing speed values. Step S44 is followed by Step S45 to identify, based on the data stored in the third and fourth information areas 17*d*, 17*e*, any particular one of the stitch-length ranges whose thread-breakage frequency is extremely high, and change (i.e., lower), by modifying the data stored in the fifth information area 17*f*, the actual sewing speed value used for forming the particular stitches falling within that particular stitch-length range, thereby reducing the thread-breakage frequency in forming those particular stitches. For example, in the event that the thread-breakage frequency exceeds one time per thousand stitches where one thread breakage per ten thousands of stitches is normal, the actual sewing speed values are lowered by twenty percent thereof.

By the repetitive implementation of the routine of FIG. 11 (11A through 11D), the EEPROM 17 accumulatively stores the operating-condition data indicative of the various operating conditions of the sewing device 1 upon detection of each thread breakage (e.g., sequential numbers of sewing head 3 and needle bar 4, maximum sewing speed, actual sewing speed, stitch length, thread thickness, recovery time period, etc.). Meanwhile, the maximum-sewing-speed-classified and stitch-length-classified actual sewing speed information (FIG. 8) stored in the fifth information area 17*f* of the EEPROM 17, are updated, at the end of each implementation of the routine, so as to reduce the thread-breakage frequency in forming a subsequent series of stitches. Consequently, the thread-breakage frequency is gradually lowered, and the sewing time duration as a whole is shortened. Thus, the sewing efficiency is improved, and the quality of the embroidery is improved.

Figure 10:
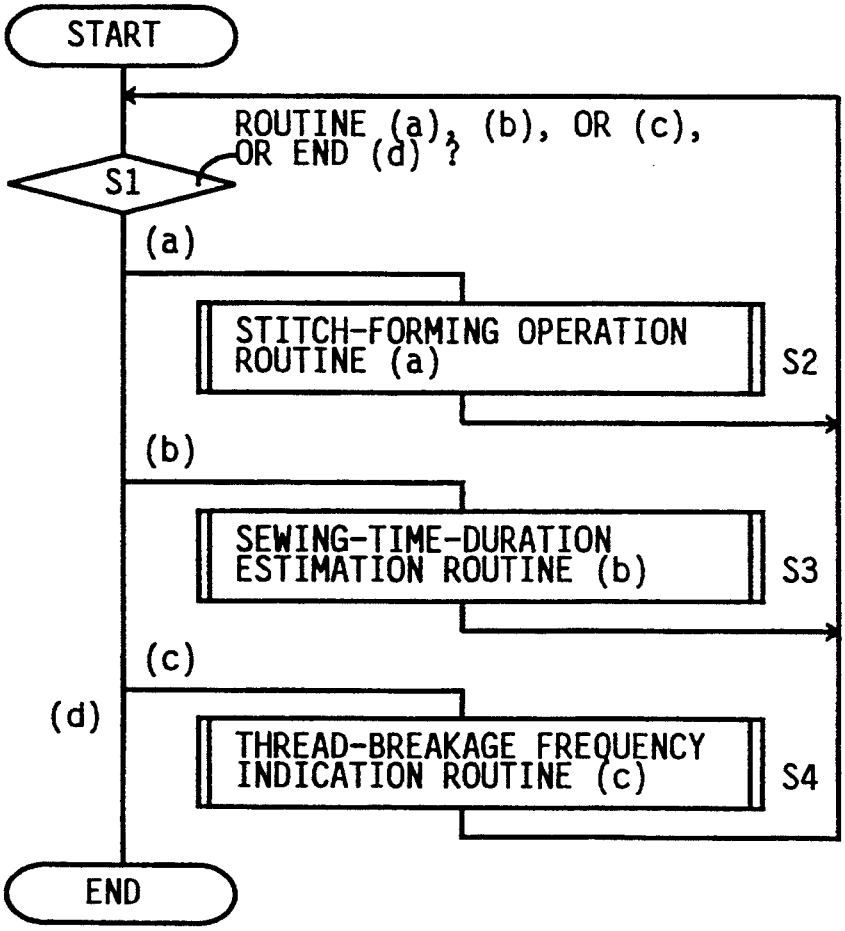
FIG. 10 is a flow chart representing a control program used for controlling the sewing system of FIG. 1.
Figure 12:
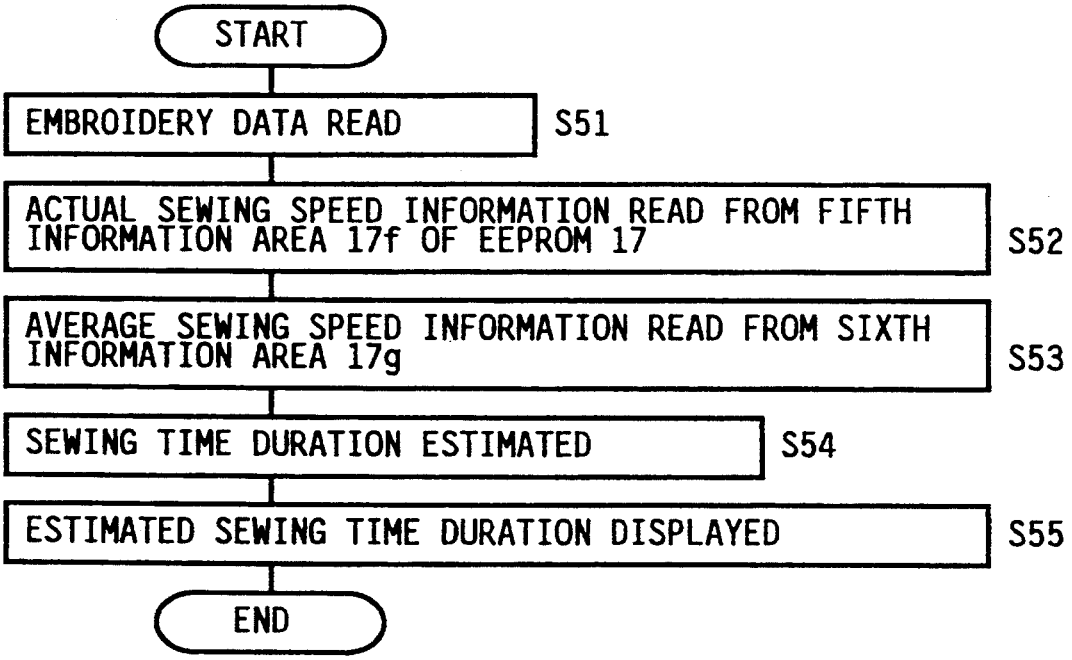
FIG. 12 is a flow chart representing a sewing-time-duration estimation program as a sub-routine of the main routine of FIG. 10.

Next, there will be described the sewing-time-duration estimation routine of Step S3 of FIG. 10, by reference to the flow chart of FIG. 12.

First, in Step S51, the CPU 16 of the control device 15 reads, from the FDD 28, the embroidery data selected by the operator. In the following Step S52, the CPU 16 reads, based on the maximum sewing speed selected by the operator through the sewing-speed adjusting device 30, a pertinent part of the actual sewing speed information (FIG. 8) from the fifth information area 17*f*. In Step S53, the CPU 16 reads, based on the pertinent actual sewing speed values and the stitch-length ranges, a pertinent part of the average sewing speed information (FIG. 9) from the sixth information area 17*g*.

Step S53 is followed by Step S54 to estimate a sewing time duration necessary for the sewing device 1 to form a series of stitches according to the embroidery data read in Step S51. More specifically, the CPU 16 calculates a length of each one of the series of stitches, based on the embroidery data, calculates a time period necessary to form each one stitch based on an average sewing speed value corresponding to the stitch length thereof, and determines the sewing time duration as a whole by summing up all the time periods necessary to form all the stitches. In Step S55, the thus calculated or estimated sewing time duration is indicated on the screen of the display device 26.

Figure 13:
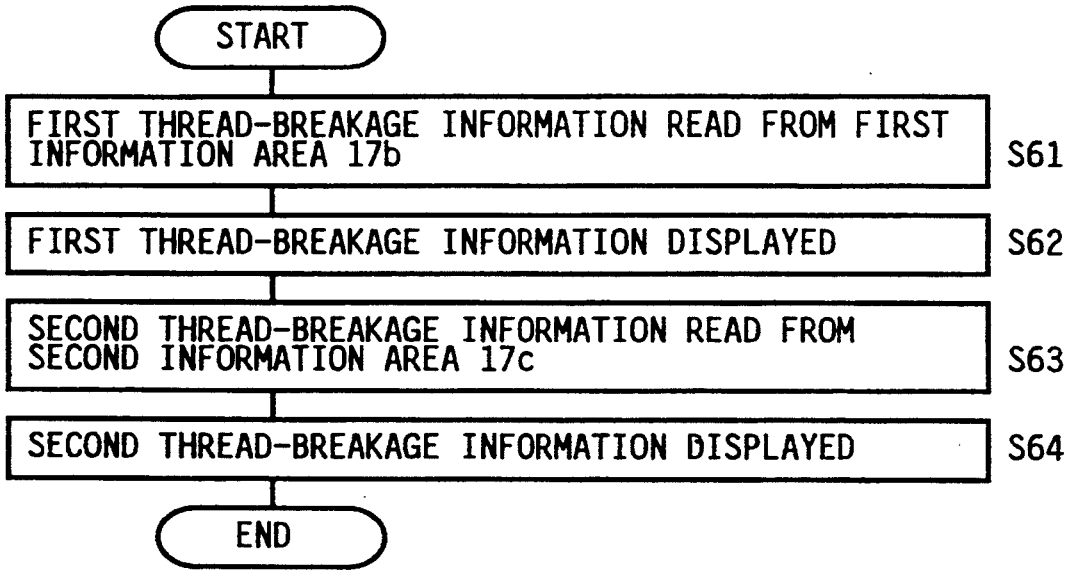
FIG. 13 is a flow chart representing a thread-breakage-frequency indication program as a sub-routine of the main routine of FIG. 10.

By taking the estimated sewing time duration into account, the operator can make an efficient production plan. Since the average sewing speed values stored in the sixth information area 17*g* are determined by considering the recovery time periods, or lost time, upon occurrence of thread breakages in the past stitch-forming operations of the sewing device 1, the reliability of the estimated sewing time duration is very high. Next, there will be described the thread-breakage frequency indication routine of Step S4 of FIG. 10, by reference to the flow chart of FIG. 13.

First, in Step S61, the CPU 16 reads, from the first information area 17*b* of the EEPROM 17, the sewing-head-classified and needle-bar-classified thread breakage information (i.e., first thread-breakage information, or the table as shown in FIG. 5). In Step S62, the CPU 16 commands the display device 26 to indicate the table of FIG. 5, so that the operator can see the thread-breakage information presented in that table. The information may otherwise be graphically presented, for example, in a bar graph.

In Step S63, the CPU 16 reads the thread-thickness-classified thread breakage information (i.e., second thread-breakage information), if any, from the second information area 17*c*. In Step S64, the CPU 16 commands the display device 26 to indicate the second thread-breakage information together with the table of FIG. 5.

From the first and second thread-breakage information indicated on the display device 16, the operator can easily identify a particular needle bar or bars 4 and/or a particular thread thickness value or values (i.e., thread number or numbers) with which thread breakage occurs at a high frequency. For avoiding using the particular needle bar or bars 4, the embroidery data may be modified. Otherwise, it is possible to provide a plurality of needle bars 4 for each one sort of thread (each one color or each one thickness value) and, if one of those bars 4 suffers from an extremely high thread-breakage frequency, automatically change it with another or the other bar 4. The stitch-forming operation may be performed by avoiding using the thread or threads having the particular thread thickness value or values (or thread number or numbers).

In the event that a thread-breakage frequency is extremely high, the operator can estimate that failure or maladjustment may have occurred to the drive mechanism of a particular needle bar 4. In this case, the operator can take appropriate countermeasures. The present sewing system may be adapted such that, when the thread-breakage frequency for a particular needle bar 4 is more than two times higher than the average of the frequencies of the other bars 4, the sewing system generates an alarm signal, such as an alarm sound, upon detection of each thread breakage. In this case, the thread-breakage frequency is calculated, and the frequency data is stored to be used for controlling an alarm device (not shown) to sound an alarm. In addition, the maximum-sewing-speed-classified thread breakage information (i.e., third thread-breakage information shown in FIG. 6) may also be indicated on the display device 26.

As is apparent from the foregoing description, the present sewing system has the function to accumulatively store the operating-condition data indicative of the sequential number of needle bar 4, actual sewing speed, stitch length, recovery time period, thread-breakage frequency, etc. upon occurrence of each thread breakage. The accumulation of the operating-condition data involves modification thereof. The sewing system has the additional function to utilize the accumulated and modified operating-condition data for the control of subsequent stitch-forming operations thereof.

Specifically, first, the control device 15 calculates a thread-breakage frequency in association with each of the needle bars 4, each of the thread thickness values, or each of the maximum sewing speed values, based on the accumulated data stored in the EEPROM 17. This is in stark contrast to the conventional sewing system in which an operator is only informed of the occurrence of each thread breakage upon detection thereof. In the present sewing system, the operator can avoid the use of a particular needle bar 4, or the selection of a particular maximum sewing speed, with which thread breakage occurs at a high frequency. In addition, the operator can quickly treat maladjustment of the drive mechanism of the particular needle bar 4. Thus, the stitch-forming operations of the present sewing system are performed at a low thread-breakage, which contributes to improving the production efficiency of the sewing system.

The control device 15 identifies a particular maximum sewing speed value or values and a particular stitch-length range or ranges with which thread breakage occurs at a high frequency, and automatically changes the actual sewing speed value or values for the particular stitch-range class or classes so as to reduce the thread-breakage frequency. Thus, the present sewing system has the "learning" function and therefore enjoys the improved production efficiency.

Furthermore, the control device 15 calculates the thread-breakage frequency based on the accumulated data stored in the EEPROM 17, and estimates a sewing time duration including one or more recovery time period or periods from one or more thread breakages which are estimated to occur at the calculated frequency. This is in stark contrast to the conventional sewing system which estimates a sewing time duration without taking into account one or more recovery time periods from one or more thread breakages which inevitably occur. Thus, the sewing time duration values estimated by the present sewing system are very reliable. This enables the operator to make a very efficient production plan.

While in the illustrated embodiment the accumulated data stored in the EEPROM 17 are utilized for three different functions, i.e., (i) changing the actual sewing speed values, (ii) estimating a sewing time duration, and (iii) displaying a thread-breakage frequency, it is however possible to adapt the sewing system to perform only one or two of the three functions.

Although in the illustrated embodiment the abnormal supply of a sewing thread to a needle bar 4 is detected by the thread-breakage sensor 9, it is possible that the sewing system employ a detector which detects, as an abnormality of the sewing device 1, a seizure of any mechanical part of the sewing device 1, or a loss of synchronism of either of the stepper motors 13, 14, and store operating-condition data upon detection of the abnormality. The seizure of a mechanical part of the sewing device 1 may be detected by measuring the electric current supplied to the motor 7, 8, 13, or 14, because the electric current is significantly increased due to the increased friction of the seized mechanical part. The measurement of the electric current may be achieved by inserting an electric resistance in series in an electric supply line to the motor and obtaining an electric analog signal which is converted into a digital signal suitable to be processed by the control device 15. The loss of synchronism of the stepper motor 12, 13 may be detected by a well-known sensor which monitors the rotation angle of the motor.

The EEPROM 17 serving as a memory which stores the operating-condition data may be replaced by an external storage device such as a hard-disk drive.

In addition to the indication of an estimated sewing time duration in advance of a sewing operation, it is possible during the sewing operation to indicate a time duration left before the end of the estimated time duration. When the left time duration is excessively short than expected, the operator can take suitable measures. Moreover, an estimated sewing time duration may be utilized to calculate the cost necessary to form an embroidery.

Next, there will be described the second embodiment of the present invention by reference to FIGS. 14 through 18. The second embodiment also relates to a multiple-head embroidery sewing system like the preceding sewing system as the first embodiment. Initially, the general arrangement of the present sewing system is described by reference to FIGS. 14 and 15.

Figure 14:
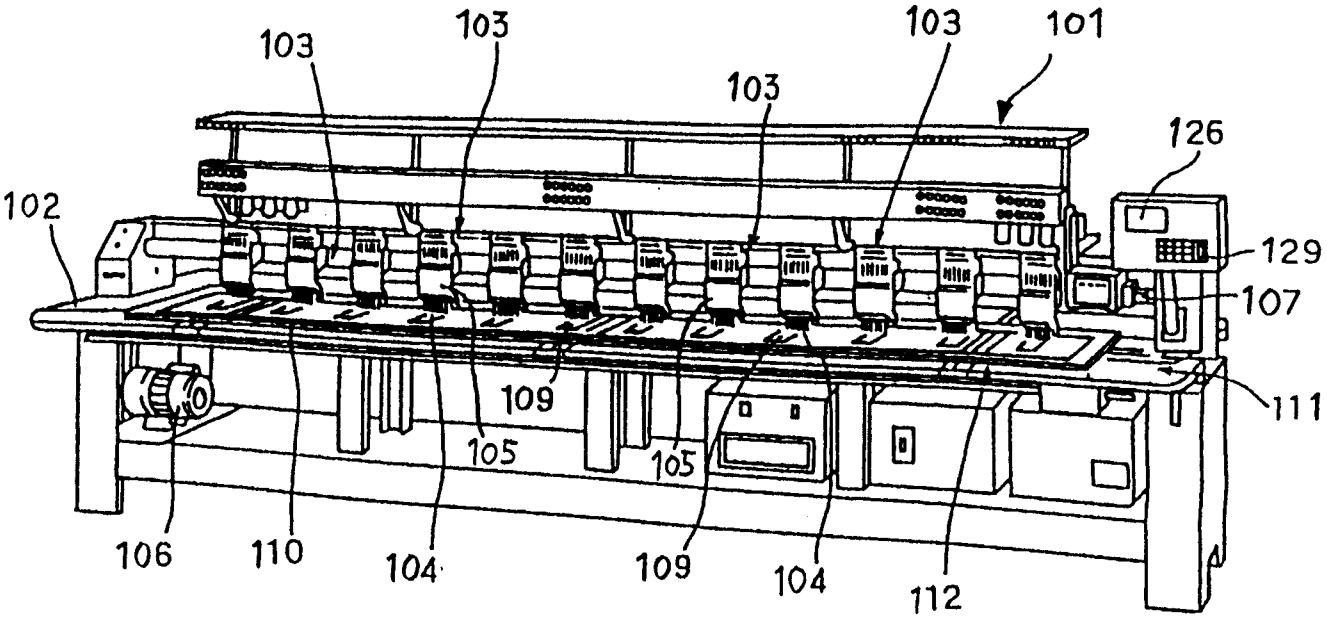
FIG. 14 is a perspective view of another multiple-head embroidery sewing system as the second embodiment of the present invention.

In FIG. 14, reference numeral 101 designates a sewing device. The sewing main device 101 includes a plurality of sewing heads 103 (twelve heads 103 are used) which are disposed above a table 102 equidistantly from each other in a longitudinal direction of the table 102, i.e., along an X axis. Each of the sewing heads 103 has a support case 105 which supports a plurality of needle bars 104 (six bars 104 are used). The six needle bars 104 of each sewing head 103 are arranged in the support case 105 along the X axis, and are supported by the case 105 such that each of the needle bars 104 vertically reciprocates. A sewing needle is attached to the lower end of each needle bar 104. Embroidery threads of different sorts (colors, thread numbers, etc.) are supplied from thread supply devices (not shown) via thread tension adjusting devices (not shown) to the respective sewing needles attached to the needle bars 104 in each sewing head 103.

Below the table 102, there is disposed a main-shaft motor 106 which rotates a main shaft (not shown) of the sewing device 1. The main-shaft motor 106 is rotated at variable speeds in steps of 50 rpm. The support cases 105 of the sewing heads 103 are driven by a common needle-bar select motor 107, so that the support cases 105 displace along the X axis. Each sewing head 103 has a drive mechanism (not shown) which converts the rotation of the main shaft into the vertical reciprocation of an operative one of the needle bars 104 which is currently indexed at an operative position in each sewing head 103 by the needle-bar select motor 107. Thus, the color-different embroidery threads are automatically changed during a sewing operation, so that a multiple-color embroidery may be formed.

A thread-breakage sensor 108, which has the same construction as that of the sensor 9 shown in FIGS. 1B and 1C, is provided for each of the needle bars 104 in each sewing head 103. The sensor 108 serves as a detector which detects an abnormality of the sewing device 1. The present sewing system has an alarm device and a thread-breakage lamp (not shown) each of which informs an operator of the occurrence of a thread breakage.

The table 102 has a bed portion 109 for each of the sewing heads 103. A loop-take mechanism (not shown) is provided in each bed portion 109 in association with a corresponding one sewing head 103, so as to cooperate with the operative needle of each sewing head 103 to form a series of stitches on a work sheet (not shown), such as a fabric or leather, which is held by a common movable frame 110. The movable frame 110 has a rectangular shape which is long along the X axis and short along a Y axis perpendicular to the X axis. The movable frame 110 supports twelve embroidery frames (not shown) such that each embroidery frame supporting a work sheet is detachable from the movable frame 110.

The movable frame 110 is adapted to be movable above the table 102 in a horizontal plane defined by the X and Y axes, so that, when being driven by a frame drive mechanism, the frame 110 is movable to any position in the horizontal plane. The drive mechanism includes an X-axis drive device 111 which moves the frame 110 along the X axis, and a Y-axis drive device 112 which moves the frame 110 along the Y axis. The X-axis drive device 111 includes an X-axis drive motor (i.e., stepper motor) 113 (FIG. 15), while the Y-axis drive device 112 includes a Y-axis drive motor (i.e., stepper motor) 114 (FIG. 15).

Figure 15:
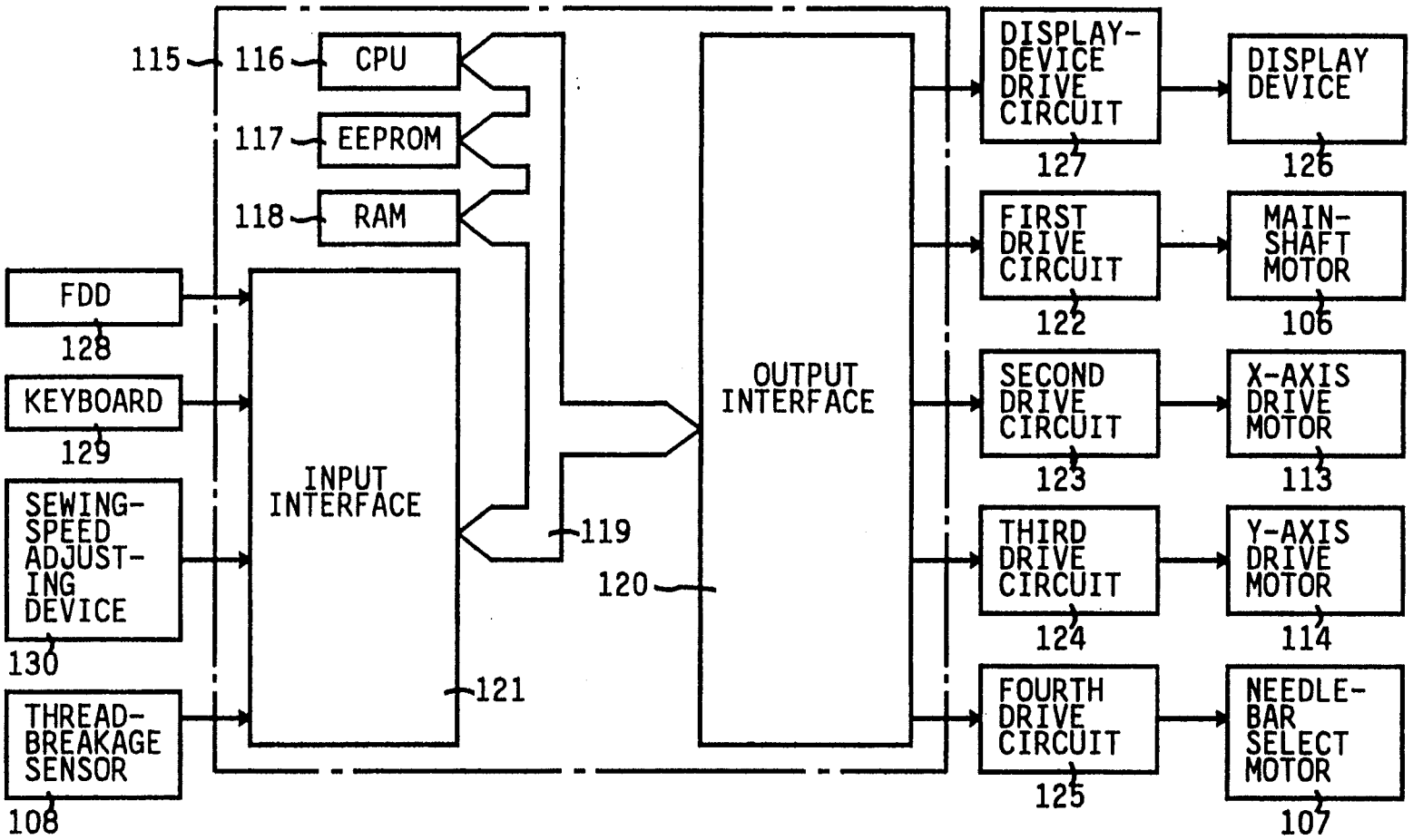
FIG. 15 is a diagrammatic view of the electric arrangement of the sewing system of FIG. 14.
Figure 17A:
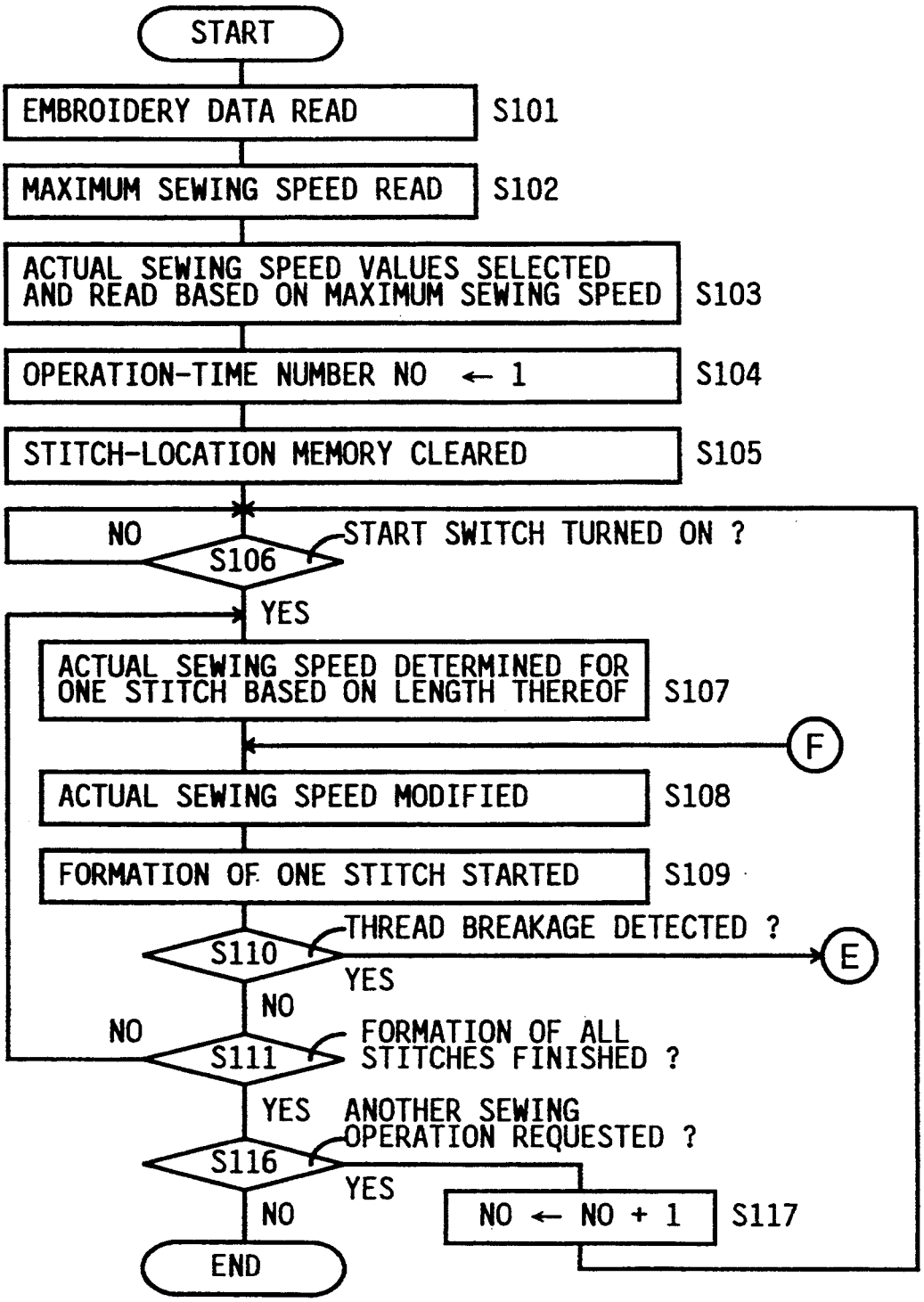
FIGS. 17A and 17B are respective portions of a flow chart representing a control program used for controlling the sewing system of FIG. 14 as the second embodiment.
Figure 17B:
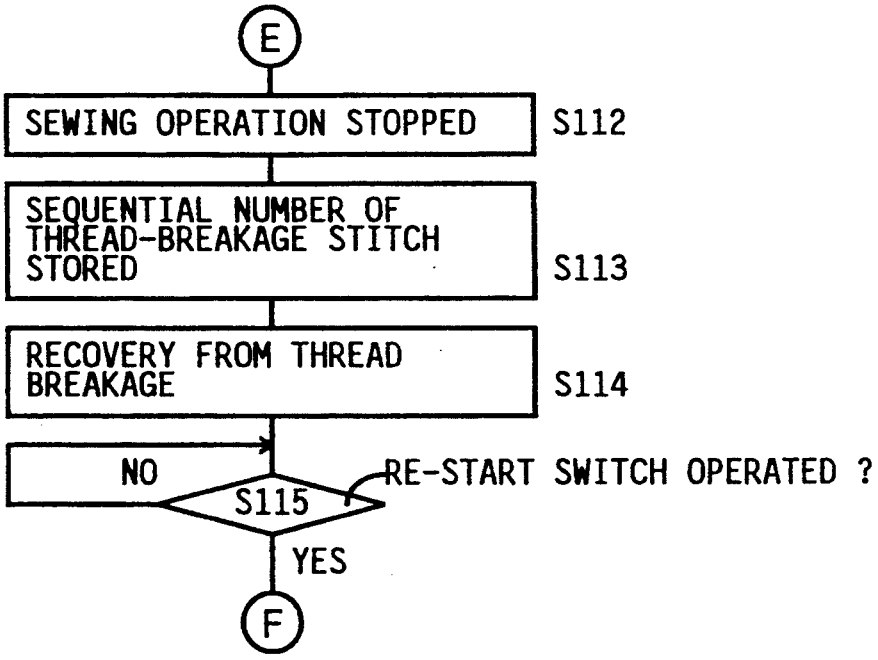

The operations of the above-described motors 106, 107, 113, and 114 are controlled by a control device 115 shown in FIG. 15. The control device 115 is essentially constituted by a computer including a central processing unit (CPU) 116, an electrically erasable/programmable read only memory (EEPROM) 117, a random access memory (RAM) 118, and bus 119 which connects the components 116, 117, 118 to each other. The control device 115 includes an output interface 120 and an input interface 121 which are connected to the components 116, 117, 118 via the bus 119.

The present sewing system includes a first, a second, a third, and a fourth drive circuit 122, 123, 124, 125 which drive the main-shaft motor 106, X-axis drive motor 113, Y-axis drive motor 114, and needle-bar select motor 107, respectively. The first to fourth drive circuits 122 to 125 are connected to the output interface 120 of the control device 115. The sewing system further includes a display drive circuit 127 which drives a display device 126 such as a cathode ray tube (CRT). The display drive circuit 127 is also connected to the output interface 120.

In addition, the sewing system includes a floppy disk drive (FDD) 128 through which the control device 115 reads embroidery data recorded on a floppy disk (not shown); a keyboard 129 through which an operator inputs various data to the control device 115; and a sewing-speed adjusting device 130 through which the operator inputs data indicative of an upper limit value of the sewing speed of the sewing device 1 (sewing speed is defined as the number of rotations per minute of the main-shaft motor 106). The FDD 128, keyboard 129, and sewing-speed adjusting device 130, as well as the thread-breakage sensors 108, are connected to the input interface 121. The control device 15, FDD 128, keyboard 129, and display device and drive circuit 126, 127 may be constituted by a personal computer like the first embodiment shown in FIG. 1A.

The embroidery data read from the FDD 128 and stored in the RAM 118 include a plurality of stitch instructions ordered in a predetermined sequence. Each stitch instruction specifies one of the needle bars 104 (or sewing needles) in each sewing head 103, by designating the sequential number assigned to that needle bar 104, and represents a stitch position where the sewing needle held by the designated needle bar 104 penetrates the work sheet to form a stitch. Each stitch instruction represents a stitch position by specifying respective amounts of displacement of the movable frame 110 relative to the designated or operative needle in each head 103 along the X and Y axes, respectively, from the preceding stitch position where the preceding stitch is formed according to the preceding stitch instruction in the above-indicated predetermined sequence. Thus, each stitch instruction defines the length of a corresponding one stitch.

The control device 115 controls the operations of the main-shaft motor 106, X-axis and Y-axis drive motors 113, 114, and needle-bar select motor 107, according to control programs stored in the EEPROM 117 and the embroidery data stored in the RAM 118, so as to automatically form a series of stitches, i.e., an embroidery on each of the work sheets held by the movable frame 110, while automatically changing the color-different threads with each other to form the individual stitches.

The EEPROM 117 includes a program area which stores the control programs, and a maximum-sewing-speed/stitch-length actual sewing speed information area which stores data indicative of an adjusted sewing speed (hereinafter, referred to as "actual sewing speed") at which to actually form stitches with stitch lengths falling within each one of different stitch-length ranges, at each one of the different sewing-speed upper-limit values, i.e., maximum sewing speeds. The maximum sewing speed is inputted by the operator through operation of the sewing-speed adjusting device 130. FIG. 16 shows a table as an example of the data stored in the above-indicated information area of the EEPROM 117. The present sewing system is adapted to determine the actual sewing speed values by lowering the operator-selected maximum sewing speed by greater amounts to form longer stitches. In general, at lower actual sewing speed values, the frequency of occurrence of thread breakage is lower.

The present sewing system automatically performs, on a software-control basis, a stitch-forming operation according to the embroidery data and the selected maximum sewing speed. It will be apparent from later description by reference to the flow chart of FIG. 17 (17A and 17B), that while the sewing system is performing a stitch-forming operation, the control device 115 stores, in the RAM 118, stitch-location data indicative of a location (i.e., sequential number) in the predetermined sequence of a particular one of a series of stitches which is being formed upon detection of a thread breakage by the thread-breakage sensor 108 associated with the currently operative sewing needle in any one of the sewing heads 103. The control device 115 utilizes the stitch-location data for lowering the actual sewing speed values which have been determined for the particular stitch, five stitches preceding the particular stitch, and five stitches following the particular stitches, so as to form the eleven stitches at the lowered actual sewing speed values.

In the event that no thread breakage occurs during the formation of those eleven stitches including the particular stitch, at the lowered actual sewing speed values, the control device 115 raises the lowered actual sewing speeds toward the actual sewing speed values originally determined for the eleven stitches. The control device 115 serves as the utilizing means in the present embodiment.

The RAM 118 includes a stitch-location memory area which stores the stitch-location data, as shown in FIG. 18, which indicate the sequential number of each of one or more particular stitches to which a thread breakage has occurred. In FIG. 18, the number "−1" means the end of a batch of stored data. The RAM 118 serves as the operation-state data memory in the present embodiment.

Hereinafter, there will be described the operation of the multiple-head embroidery sewing system constructed as described above, by reference to the flow chart of FIG. 17 (17A and 17B) and the table of FIG. 18. In the present embodiment, the control device 115 operates for controlling the sewing system according to the flow chart of FIG. 17.

Upon application of electric power to the present sewing system, the control of the CPU 116 of the control device 115 begins with Step S101 to read, from the FDD 128, the embroidery data selected by an operator and store the data in the RAM 118. At the following Step S102, the CPU 116 reads the upper-limit value of the sewing speed (i.e., maximum sewing speed) selected by the operator through the sewing-speed adjusting device 130. Step S102 is followed by Step S103 to read, from the EEPROM 17, the data indicative of an actual sewing speed to form stitches falling within each one of the different stitch-length ranges at the selected maximum sewing speed.

The data stored in the EEPROM 117 are shown in the table of FIG. 16. The table shows that, in the event that the selected maximum sewing speed is 500 rpm, for example, the sewing device 101 is controlled to form stitches with not greater than 1.0 mm lengths, at an actual sewing speed of 500 rpm; 1.0 to 3.0 mm long stitches at 500 rpm; 3.0 to 6.0 mm stitches at 450 rpm; and 6.0 to 12.0 mm stitches at 400 rpm.

Step S103 is followed by Step S104 to set a operation-time number counter, NO, of the RAM 108, to NO=1 indicating that the sewing device 1 is currently in the first time sewing operation according to the embroidery data read at Step S101. At the following step S105, the CPU 116 clears the contents of the stitch-location data memory of the RAM 118. In this situation, the operator mounts desired sorts of threads (i.e., needle threads) on the respective needle bars 104 (or sewing needles) in each sewing head 103, and also mounts desired work sheets on the respective embroidery frames supported by the movable frame 110. Then, the operator turns on a 'start' switch on the keyboard 129.

When the operator turns on the start switch, a positive judgement is made in Step S106, and the control of the CPU 106 goes to Step S107 to calculate the length of a current stitch to be formed, based on the embroidery data, and determine an actual sewing speed to form the current stitch based on the thus determined length thereof and the actual sewing speed information (FIG. 16) read from the EEPROM 117 at Step S103.

Step S107 is followed by Step S108 to modify the actual sewing speed value determined for the current stitch if the current stitch is a particular stitch to which a thread breakage had been detected, or one of the five preceding and five following stitches of the particular stitch in the predetermined sequence. Step S108 will be described later in detail. In the event that no thread breakage had been detected up till then, no actual sewing speed value is modified in Step S108.

Step S108 is followed by Step S109 to form the current stitch at the actual sewing speed value determined at Step S107 or modified at Step s108. At the following Step S110, the control device 115 judges whether any one of the thread-breakage sensors 108 has produced a detection signal indicating that that sensor 108 has detected the occurrence of a breakage of the thread supplied to the needle associated with that sensor 108, during the formation of the current stitch at Step S108. So long as no detection signals are present, that is, so long as negative judgements are made in Step S110, the sewing device 101 continues to form individual stitches in the predetermined sequence until all the stitches are formed and thus a positive judgement is made in Step S111.

Meanwhile, if any one of the sensors 108 has detected a thread breakage, a positive judgement is made in Step S110. In this event, the control of the CPU 116 goes to Step S112 to stop all the stitch-forming operations of the sewing heads 103. At the same time, a buzzer (not shown) is driven to issue an alarm sound, or a lamp (not shown) is lit, so as to inform the operator that a thread breakage has occurred. Step S112 is followed by Step S113 to store, in the stitch-location data memory of the RAM 18, stitch-location data indicative of the sequential number of a particular stitch to which the thread breakage occurred. The stitch-location data shown in FIG. 18 indicate that a thread breakage had occurred to the 150th and 2005th stitch during the first-time sewing operation according to the embroidery read at Step S101.

In the following Step S114, the operator attends to the sewing device 101 for restoring it from the thread breakage. When the operator operates a re-start stitch on the keyboard 129 after recovery from the thread breakage, a positive judgement is made in Step S115, and the control of the CPU 116 goes back to Step S108 to resume the normal sewing operation for forming the remaining stitches of the embroidery. In the present embodiment, upon operation of the re-start stitch after the temporary stopping of a sewing operation due to the detection of a thread breakage, the sewing needle to which the thread breakage occurred is moved backward relative to the corresponding embroidery frame supported by the movable frame 110, by reading in the reverse sequence the stitch instructions of the embroidery data, by a predetermined number of stitches (e.g., five stitches) from the particular stitch. Thereafter, the normal sewing operation is reseed in the normal sequence of the stitch instructions.

When all the stitches have been formed according to the embroidery data read in Step S101, a positive judgement is made in Step S111. In this event, the control of the CPU 16 goes to Step S116 to indicate, on the display device 126, a question whether the operator plans to form the same embroidery one more time. When the operator answers "YES", a positive judgement is made in Step S116, and the control goes to Step S117 to increment by one the content of the operation-time number counter NO. Then, the control of the CPU 116 goes back to Step S106 so as to form the same embroidery into new work sheets mounted on the respective embroidery frames in place of the finished work sheets.

While the formation of the same embroidery is repeated according to the embroidery data read at Step S101, the control device 115 operates in Step S108 to lower eleven actual sewing speed values determined for a particular stitch to which a thread breakage had occurred, and five stitches preceding the particular stitch, and five stitches following the particular stitch. In the present embodiment, if the difference number, (NO—NOx), between the operation-time number NO of the current sewing operation of an embroidery and the operation-time number, NOx, of the last sewing operation of the same embroidery when a thread breakage had occurred to a particular stitch, is zero or one, the actual sewing speed values determined at Step S107 to form the particular stitch and the five preceding and five following stitches of the particular stitch in the current sewing operation, are modified, i.e., lowered to half those actual sewing speed values, respectively.

Meanwhile, if the difference number (NO—NOx) is two, the actual sewing speed values are lowered to two thirds thereof; and if the difference number (NO—NOx) is three or four, the actual sewing speed values are lowered to five sixths thereof. If the difference number (NO—NOx) is not less than five, no actual sewing speed value is modified or lowered because the thread breakage is judged as having occurred due to a mere accident. In the last case, the actual sewing speed values determined at Step S107 are used, without being modified, to form the eleven stitches including the particular stitch.

Regarding the example shown in FIG. 18, a thread breakage had occurred to the 150th and 2005th stitches in the first-time sewing operation of the embroidery. Therefore, in the next, second-time sewing operation of the same embroidery, the actual sewing speed values for the 145th to 155th stitches and the 2000th to 2010th stitches are lowered to half those actual sewing speed values, respectively. And, no thread breakage occurred during the second-time sewing operation. Thus, in the third-time sewing operation, the actual sewing speed values for the 145th–155th and 2000th–2010th stitches are lowered to two thirds of those values, respectively.

However, in the third-time sewing operation, a thread breakage occurred to the 150th stitch again. Therefore, in the fourth-time sewing operation, the actual sewing speed values for the 145th to 155th stitches are lowered to half those values, respectively, and the actual sewing speed values for the 2000th to 2010th stitches are lowered to five sixths of those values, respectively. When a sewing needle and a corresponding embroidery frame are moved backward relative to each other after the detection of a thread breakage and subsequently a normal sewing operation is resumed, the difference number (NO—NOx) is zero, so that actual sewing speed values for a predetermined number of stitches including a particular stitch to which the thread breakage occurred are lowered to half those values, respectively.

As emerges from the foregoing description, the RAM 118 of the control device 115 stores the stitch-location data indicative of the sequential number of a particular stitch to which a thread breakage has occurred. When thereafter the particular stitch is formed again, the actual sewing speed determined for the particular stitch is lowered to a reference level, specifically, is lowered to a predetermined speed value or is lowered by a predetermined speed amount. Thus, when the formation of an embroidery is repeated, the present sewing system prevents thread breakage from iteratively occurring to a particular stitch for the intrinsic reason relating to the manner of arrangement of the embroidery data for the embroidery. This is in stark contrast to the conventional sewing system wherein thread breakage will occur again and again to a same particular stitch in a predetermined sequence, thereby lowering the production efficiency of the sewing system. Thus, the present sewing system enjoys improved sewing efficiency. In addition, the present sewing system produces an embroidery of improved quality.

The lowering of actual sewing speed values to prevent the occurrence of a thread breakage is automatically effected without needing any intervention of an operator, and only with respect to a predetermined number of stitches including a particular stitch to which the thread breakage occurred. Thus, the operator is not required to newly input data indicative of new actual sewing speed values for that predetermined number of stitches. Furthermore, since the stitches other than that predetermined number of stitches including the particular stitch are formed at the non-lowered, original actual sewing speeds, a sewing time duration as a whole necessary to finish the formation of all the stitches is not increased so much. Thus, the sewing efficiency is not adversely affected.

If no thread breakage occurs after the lowering of actual sewing speed values for a predetermined number of stitches including a particular stitch to which a thread breakage occurred, the lowered actual sewing speed values are gradually raised toward the original values, respectively, so as to form the corresponding stitches. In the event that a thread breakage occurred due to a mere accident, not due to the intrinsic reason related to the manner of arrangement of the embroidery data, the degree of lowering of the actual sewing speed values is restricted to a minimum. Thus, the present sewing system enjoys sufficient sewing efficiency.

While in the second embodiment the actual sewing speed for a particular stitch to which a thread breakage occurred is changed in steps depending upon the difference number (NO−NOx), it is possible to simply lower the actual sewing speed to a reference level so as to form the particular stitch after detection of the thread breakage.

Next, there will be described the third embodiment of the present invention by reference to FIGS. 19 through 21. The third embodiment relates to a multiple-head embroidery sewing machine having a construction generally similar to that of the preceding, second embodiment. Therefore, in the following description of the third embodiment, reference is made only to the differences between the present sewing system and the preceding system. The same reference numerals as used in FIGS. 14 and 15 relating to the second embodiment, are used in the following description.

Figure 19:
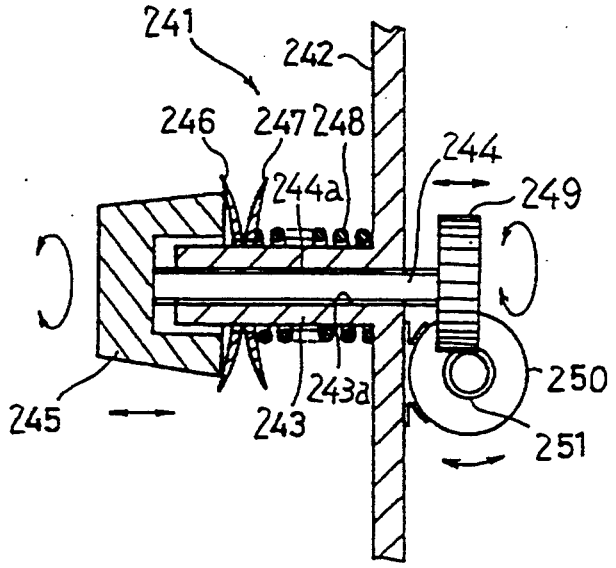
FIG. 19 is a cross-sectional view of a thread-tension adjusting device 241 employed in yet another multiple-head embroidery sewing system as the third embodiment of the present invention.

In the present sewing system, a control device 115 thereof can automatically operate a thread-tension adjusting device 241, shown in FIG. 19, to modify the tension of an embroidery thread (i.e., needle thread) supplied to each one of sewing needles secured to respective needle bars 104 in each one of sewing heads 103 of a sewing device 101. An operator can also modify the thread tension by manually operating the adjusting device 241.

The thread-tension adjusting device 241 includes a support member 242 fixed to the sewing device 101. The support member 242 has a cylindrical portion 243 which has a small diameter and whose inner surface 243*a* is internally threaded. The adjusting device 241 also includes an axis member 244 whose outer surface 244*a* is externally threaded. The axis member 244 is threadedly engaged with the cylindrical portion 243 of the support member 242, such that the axis member 244 extends through the cylindrical portion 243. To one of opposite ends of the axis member 244, a knob member 245 is secured, which is to be rotated by the operator to adjust the tension of the embroidery thread associated with the adjusting device 241. A pair of thread-tension discs 246, 247 movably fit around the outer surface of the cylindrical portion 243 of the support member 242, such that the associated embroidery thread is sandwiched between the first and second discs 246, 247. A coil spring 248 is disposed between the second disc 247 and a wall portion of the support member 242.

To the other end of the axis member 244, a wheel 249 is fixed which is disposed on the rear side of the wall portion of the support member 242. On the same side, a thread-tension adjust motor 250 is provided. A worm gear 251 is fixed to the output shaft of the adjust motor 250 on one hand, and on the other hand the gear 251 is in mesh with the wheel 249. The adjust motor 250 is controlled by the control device 155 by selectively applying an electric current thereto.

When the operator rotates the knob member 245, the axis member 244 is advanced or retracted relative to the wall of the support member 242, so that the pair of discs 246, 247 are displaced in the axial direction of the axis member 244. Consequently, the pinching force exerted to the embroidery thread by the pair of discs 246, 247 is changed and therefore the tension of the thread is adjusted. Alternatively, when the control device 155 applies an electric current to the thread-tension adjust motor 250, the axis member 244 is similarly displaced relative to the support member 242. Thus, the tension of the needle thread is automatically changed. In the present embodiment, when the adjust motor 250 is rotated in a forward direction, the thread tension is increased; and when the adjust motor 250 is rotated in a reverse or backward direction, the thread tension is decreased.

In the present embodiment, the control device 155 is adapted to modify the thread tension as a control condition of the sewing device 101, in place of the actual sewing speed of the sewing device 101 in the preceding embodiment. In general, less thread breakages occur at lower thread tensions.

Figure 20A:
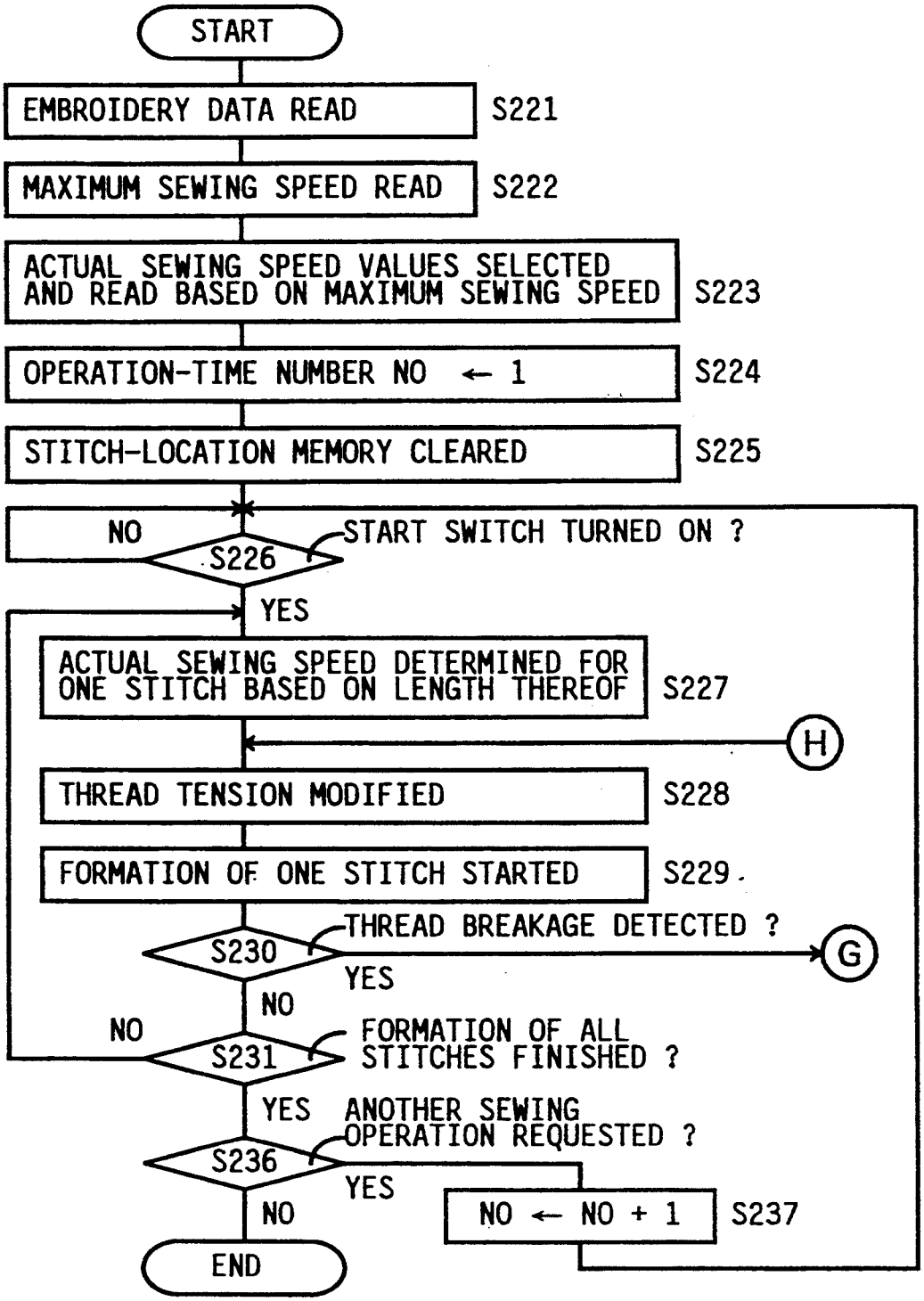
FIGS. 20A and 20B are respective portions of a flow chart representing a control program used for controlling the sewing system as the third embodiment.
Figure 20B:
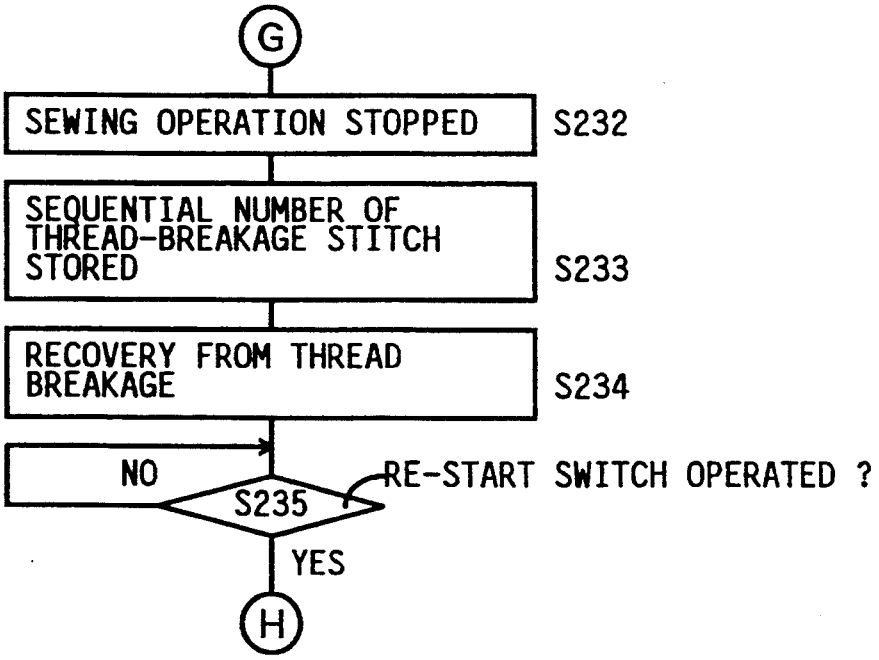

The present sewing system performs stitch-forming or sewing operation on a software-control basis, i.e., according to the control program represented by the flow chart of FIG. 20 (20A and 20B). While the sewing system is performing the stitch-forming operation, the control device 115 stores, in a RAM 118 thereof, stitch-location data indicative of a location (i.e., sequential number) in a predetermined sequence of a particular one of a series of stitches as an embroidery which stitch is being formed upon detection of a thread breakage by a thread-breakage sensor 108. In addition, the control device 115 utilizes the stitch-location data for lowering the thread tension which has been set by the operator through manual operation of the knob member 245 before starting of the current stitch-forming operation, so as to form at the lowered thread tension the particular stitch and the five preceding and five following stitches of the particular stitch in the predetermined sequence in one or more subsequent stitch-forming operations of the same embroidery.

In the event that no thread breakage occurs during a subsequent formation of the eleven stitches including the particular stitch at the lowered thread tension, the control device 115 raises the lowered thread tension toward the thread tension originally selected by the operator. Thus, the control device 115 serves as the utilizing means in the present embodiment.

The present sewing system is operated according to the flow chart of FIG. 20 (20A and 20B). Since the flow chart of FIG. 20 is basically similar to that of FIG. 17 (17A and 17B), only the differences between the two flow charts will be described below.

In Step S227, an actual sewing speed value for each one of the stitches represented by embroidery data read in Step S221, is determined based on the stitch length thereof and the maximum sewing speed read at Step S222 which speed had been set by an operator through operation of a sewing-speed adjusting device 130, according to maximum-sewing-speed-classified and stitch-length-classified actual sewing speed information (cf. FIG. 8) read from an EEPROM 117 at Step S223. The thus determined actual sewing speed value is not modified at any subsequent steps in the present embodiment.

Step S227 is followed by Step S228 to lower the thread tension originally set by the operator by applying an electric current to the thread-tension adjusting device 241, with respect to a current stitch if the current stitch is a particular stitch to which a thread breakage had occurred (a positive judgement is made in Step S230 and stitch-location data indicative of the sequential number of the particular stitch is stored in the RAM 118 at Step S233), or one of the five preceding and five following stitches of the particular stitch in the predetermined sequence of the series of stitches as the embroidery.

In the present embodiment, as shown in FIG. 21, the thread tension is automatically lowered depending upon the difference number, (NO−NOx), between an operation-time number, NO, of the current stitch-forming operation of an embroidery and an operation-time number, NOx, of the last stitch-forming operation of the same embroidery when the last thread breakage had occurred to the particular stitch. More specifically, when the difference number (NO−NOx) is zero or one, the thread-tension adjust motor 250 of the adjusting device 241 is rotated in the reverse direction by two full turns from the initial angular position thereof, so as to largely lower the thread tension originally selected by the operator.

As shown in FIG. 21, when the difference number (NO−NOx) is two, three, four, or not less than five, the adjust motor 250 is rotated in the reverse direction by one and half turn, one full turn, a half turn, and a quarter turn from the initial angular position thereof. Thus, as the difference number (NO−NOx) becomes greater, the angular amount of rotation of the adjust motor 250 becomes smaller. That is, the lowered thread tension is gradually raised toward the original level selected by the operator.

As emerges from the foregoing description, the control device 115 stores, in the RAM 118, the stitch-location data indicative of the sequential number of a particular or thread-breakage stitch to which a thread breakage occurred. When thereafter the special stitch is formed, the initial thread tension set by the operator is lowered to a reference level, specifically lowered to a predetermined thread tension value or lowered by a predetermined tension amount. Thus, when the formation of an identical embroidery is repeated, the present sewing system effectively prevents thread breakage from iteratively occurring to a particular stitch due to an intrinsic cause relating to the manner of arrangement of embroidery data or stitch instructions, i.e., cause which tends to produce a thread breakage at that particular stitch. Thus, like the preceding embodiment, the present sewing system enjoys improved sewing efficiency, and additionally produces an embroidery with high quality.

The lowering of thread tension to prevent the occurrence of thread breakage is automatically effected without needing any intervention of an operator and only with respect to a predetermined number of stitches including a thread-breakage stitch. Thus, the operator is not required to re-adjust the thread tension for a particular sewing needle to which a thread breakage occurred. Furthermore, since the stitches other than the predetermined number of stitches including the thread-breakage stitch are formed at the non-lowered, original thread tension, that is, since the sewing device 101 does not form all the stitches at the lowered thread tension, the quality of the embroidery produced is not adversely affected. In addition, since the actual sewing speed values at which to form the respective stitches are not lowered, a sewing time duration necessary to finish the formation of all the stitches is not increased. Thus, the sewing efficiency is not lowered.

If no thread breakage occurs after the lowering of thread tension for a predetermined number of stitches including a thread-breakage stitch, the lowered thread tension is gradually raised toward the original level so as to form the predetermined number of stitches at the thus raised tension in subsequent stitch-forming operations. In the event that a thread breakage occurred due to a mere accident, not due to the intrinsic reason relating to the manner of arrangement of embroidery data, the degree of lowering of the thread tension is restricted to a minimum. Thus, the present sewing system forms the embroidery by minimizing unnecessary loosening of the thread sewn into the work sheet.

While in the third embodiment the thread tension for a thread-breakage stitch is changed in steps depending upon the difference number (NO−NOx), the sewing system may be adapted to merely lower the thread tension to a predetermined level or by a predetermined amount so as to form the thread-breakage stitch at the lowered tension level after the detection of the thread breakage.

Although in the second and third embodiments the control device 115 is adapted to modify either the actual sewing speed values or the thread tension, it is possible to adapt the control device 115 to modify both the actual sewing speed and the thread tension, for preventing the occurrence of thread breakage.

In addition, for preventing the occurrence of thread breakage due to an intrinsic cause with embroidery data, it is possible to adapt the control device 115 to modify various control conditions of the sewing device 101 other than the actual sewing speed and the thread tension; such as the timing of feeding of the movable frame 110, and the manner of acceleration and deceleration of the movable frame 110 (i.e., manner of application and non-application of electric current to the drive motors 113, 114).

The thread-tension adjusting device 241 employed in the third embodiment may otherwise be embodied than the illustrated manner.

Figure 22:
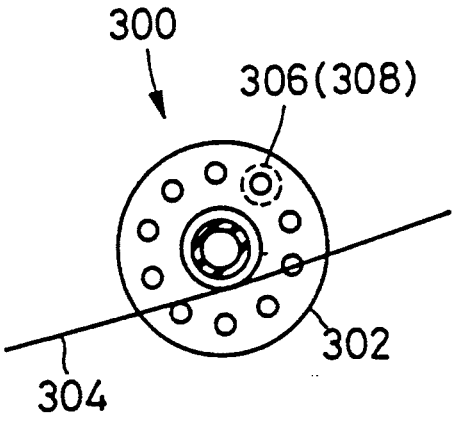
FIG. 22 is a view of a different thread-breakage sensor 300 which may be employed in any of the first to third embodiments.

The thread-breakage sensor 9, 108 employed in the illustrated embodiments may be replaced by a different sensor 300 as shown in FIG. 22. The thread-breakage sensor 300 includes a disc member 302 which has a disc portion with equiangularly spaced-apart holes and a central flanged portion around which a needle thread 304 is wound by one turn. The sensor 300 further includes a light emitting member 306 and a light detecting member 308 which are opposed to each other with respect to the disc 302. When the thread 304 is normally supplied to a needle, the disc 302 is rotated so that the light detector 308 detects the light from the light emitter 306 at regular intervals. However, when the thread 304 has broken, the disc 302 is not rotated and the light detector 308 does not detect the light at such intervals. Thus, the sensor 300 detects a thread breakage.

Figure 23:
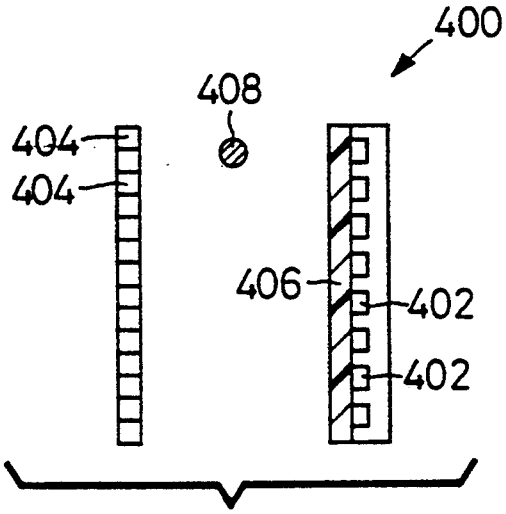
FIG. 23 is a view of a thread-tension abnormality detector 400 which may be employed in any of the first to third embodiments.

In each of the illustrated embodiments, it is possible that the sewing system be provided with a detector which detects, as an abnormality of the sewing device 1, 101, an abnormal thread tension of a needle thread supplied to a sewing needle of the sewing device 1, 101. FIG. 23 shows the thread-tension abnormality detector 400. The detector 400 includes a multiplicity of light emitting elements 402 (e.g., light emitting diodes) arranged in an array, and a multiplicity of light detecting elements 404 which are opposed to the light emitters 402. The array of light emitters 402 is covered with a light-diffusing resin 406. Reference numeral 408 designates a thread-tension spring which supports a needle thread (not shown) and vertically reciprocates together with the thread when the thread is normally supplied to a sewing needle. However, if the thread is under an extremely high tension, the spring 408 is displaced by an extremely large amount which is detected as an abnormality by the light detectors 404.

While the first, second and third embodiments relate to a multiple-head embroidery sewing machine, the principle of the present invention is applicable to a single-head sewing machine. The present invention is also applicable to a sewing machine other than an embroidery sewing machine; such as a sewing machine wherein a work sheet is fed in a single direction by a feed dog employed in place of the embroidery frame 10 or movable frame 110.

It is to be understood that the present invention may otherwise be embodied with various changes, improvements and modifications that may occur to those skilled in the art without departing from the spirit and scope of the invention defined in the appended claims.

What is claimed is:

1. A sewing system comprising:

a sewing device which includes (a) a sewing needle, (b) a first driver to reciprocate the needle, (c) a second driver to move the needle and a work sheet relative to each other in a direction crossing an axis line of the needle, and (d) a synchronizer to synchronize the reciprocation of the needle and the relative movement of the needle and work sheet, with each other, so as to form a series of stitches on the work sheet;

a detector connected to the sewing device to detect an abnormality of the sewing device;

a memory connected to the sewing device and the detector to store operation-state data indicative of an operation state of the sewing device in which state said abnormality has been detected by the detector; and utilizing means for utilizing the stored operation-state data for control of the sewing system.

2. The sewing system according to claim 1, wherein said abnormality relates to a stitch-forming operation of the sewing device to form said series of stitches.

3. The sewing system according to claim 2, wherein said abnormality relates to a sewing thread supplied to the sewing needle during the formation of said series of stitches.

4. The sewing system according to claim 3, wherein the detector comprises a sensor which detects, as said abnormality, a breakage of said sewing thread.

5. The sewing system according to claim 1, wherein the memory stores, as said operation-state data, abnormality-frequency data indicative of a frequency of occurrence of said abnormality per unit operation amount of the sewing device.

6. The sewing system according to claim 5, wherein the memory stores said abnormality-frequency data indicative of a frequency of occurrence of said abnormality per unit number of stitches , said unit number of stitches corresponding to said unit operation amount of the sewing device.

7. The sewing system according to claim 5, further comprising informing means for providing an operator with a signal indicating that said frequency of occurrence of said abnormality is higher than a reference level, the utilizing means utilizing said abnormality-frequency data for operating the informing means to provide the operator with said signal.

8. The sewing system according to claim 5, further comprising modifying means for modifying a control condition of the sewing device so as to reduce said frequency of occurrence of said abnormality during formation of a second series of stitches after the formation of said series of stitches as a first series of stitches, the utilizing means utilizing said abnormality-frequency data for operating the modifying means to modify said control condition of the sewing device.

9. The sewing system according to claim 5, further comprising estimating means for estimating a frequency of occurrence of said abnormality during formation of a second series of stitches after the formation of said series of stitches as a first series of stitches, and estimating a time duration necessary to form said second series of stitches, based on the estimated frequency, such that the estimated time duration includes a time period necessary to recover from said abnormality occurring at the estimated frequency, the utilizing means utilizing said abnormality-frequency data for operating the estimating means to estimate the abnormality-occurrence frequency and the stitch-formation time duration.

10. The sewing system according to claim 9, wherein the estimating means comprises measuring means for measuring a time period between the detection of said abnormality of the sewing device and resumption of a normal stitch-forming operation of the sewing device after the detection of said abnormality.

11. The sewing system according to claim 1, wherein the memory stores, as the operation-state data, at least one set of operating-condition data indicative of at least one operating condition of the sewing device, each time the detector detects said abnormality during formation of said series of stitches, and thereby stores an accumulation of at least two sets of the operating-condition data for at least two abnormalities that have occurred during formation of said series of stitches.

12. The sewing system according to claim 11, wherein the memory stores the operating-condition data each time the detector detects said abnormality during formation of a second series of stitches after the formation of said series of stitches as a first series of stitches, thereby storing an accumulation of the operating-condition data for said second series of stitches, and adding the accumulated operating-condition data for said second series of stitches to the accumulated operating-condition data for said first series of stitches.

13. The sewing system according to claim 12, wherein the memory comprises an erasable and programmable read only memory.

14. The sewing system according to claim 11, wherein the sewing device comprises a plurality of sewing needles, said at least one operating condition of the sewing device comprising an identification of one of the sewing needles which is being used upon detection of said abnormality.

15. The sewing system according to claim 14, wherein the sewing device forms said series of stitches according to a plurality of stitch instructions each of which designates a corresponding one of the sewing needles.

16. The sewing system according to claim 11, wherein the sewing device comprises a plurality of sewing needles ordered in a predetermined sequence, and wherein the sewing system further comprises input means for inputting data indicative of a thickness of a sewing thread supplied to each of the sewing needles, said at least one operating condition of the sewing device comprising a thickness of the sewing thread supplied to one of the sewing needles which is being used upon detection of said abnormality.

17. The sewing system according to claim 11, wherein the sewing device forms said series of stitches according to a plurality of stitch instructions each of which represents a stitch position where the sewing needle penetrates the work sheet to form a corresponding one of said series of stitches, said at least one operating condition of the sewing device comprising a distance between two successive stitch positions that is equal to a length of one of said series of stitches which is being formed upon detection of said abnormality.

18. The sewing system according to claim 11, further comprising input means for inputting data indicative of an upper limit of a sewing speed of the sewing device to form said series of stitches, said at least one operating condition of the sewing device comprising the upper limit of said sewing speed for said series of stitches.

19. The sewing system according to claim 11, further comprising input means for inputting data indicative of an upper limit of a sewing speed of the sewing device to form said series of stitches, and determining means for determining, based on said upper limit of said sewing speed and a length of each of said series of stitches, an actual sewing speed of the sewing device to form said each stitch, such that said actual sewing speed is not higher than the upper-limit sewing speed, said at least one operating condition of the sewing device comprising an actual sewing speed of the sewing device to form one of said series of stitches which is being formed upon detection of said abnormality.

20. The sewing system according to claim 19, further comprising modifying means for modifying, for reducing said frequency of occurrence of said abnormality during formation of a second series of stitches after the formation of said series of stitches as a first series of stitches, an actual sewing speed of the sewing device to form at least one stitch out of said second series of stitches, such that the modified actual sewing speed is lower than the actual sewing speed determined for at least one stitch out of said first series of stitches, said at least one stitch of said first series of stitches and said at least one stitch of said second series of stitches having respective lengths falling within a same range of stitch length.

21. The sewing system according to claim 11, further comprising a counter which counts a number of occurrence of said abnormality in association with each of said at least one operating condition of the sewing device.

22. The sewing system according to claim 1, wherein the sewing device forms said series of stitches in a predetermined sequence, the memory storing, as said operation-state data, stitch-location data indicative of a location in said predetermined sequence of a special one of said series of stitches which is being formed upon detection of said abnormality, the utilizing means utilizing said stitch-location data for modifying a control condition of the sewing device so as to form at least said special stitch under the modified control condition.

23. The sewing system according to claim 22, wherein the detector comprises a sensor which detects, as said abnormality, a breakage of a sewing thread supplied to the sewing needle.

24. The sewing system according to claim 22, wherein the memory stores the stitch-location data each time the detector detects said abnormality, the utilizing means judging whether the stored stitch-location data indicate that the sewing device is in a predetermined operation state for modifying said control condition of the sewing device, and utilizing, when a positive judgement is provided, said stored stitch-location data for modifying said control condition of the sewing device so as to form at least said special stitch under the modified control condition.

25. The sewing system according to claim 24, wherein, each time the detector detects said abnormality, the utilizing means judges that said stored stitch-location data indicate that the sewing device is in said predetermined operation state, and utilizes said stored stitch-location data for modifying said control condition of the sewing device.

26. The sewing system according to claim 24, wherein the utilizing means utilizes said stored stitch-location data for lowering a sewing speed of the sewing device as said control condition, to a first level so as to form at least said special stitch at the first sewing-speed level after said positive judgement is provided.

27. The sewing system according to claim 26, wherein the utilizing means raises said sewing speed of the sewing device to a second level higher than said first sewing-speed level when said abnormality does not occur in forming said special stitch at said first sewing-speed level after said positive judgement is provided.

28. The sewing system according to claim 24, wherein the utilizing means utilizes said stored stitch-location data for lowering a tension of a sewing thread supplied to the sewing needle as said control condition, to a first level so as to form at least said special stitch at the first thread-tension level after said positive judgement is provided.

29. The sewing system according to claim 28, wherein the utilizing means raises said tension of said sewing thread to a second level higher than said first thread-tension level when said abnormality does not occur in forming said special stitch at said first thread-tension level after said positive judgement is provided.

30. The sewing system according to claim 24, wherein the utilizing means utilizes said stored stitch-location data for modifying said control condition of the sewing device so as to form a first predetermined number of sequential stitches including said special stitch under the modified control condition after said positive judgement is provided.

31. The sewing system according to claim 30, further comprising returning means for returning, upon detection of said abnormality, the sewing needle relative to said work sheet over a length corresponding to a second predetermined number of sequential stitches including said special stitch, the utilizing means modifying said control condition of the sewing device so as to form said first predetermined number of sequential stitches under the modified control condition after the returning of the sewing needle relative to said work sheet.

32. The sewing system according to claim 1, further comprising a control device including the memory and the utilizing means, the control device being connected to the sewing device and the detector.

33. The sewing system according to claim 32, wherein the control device comprises a computer including a data processing unit.

34. A sewing system comprising:

a sewing device which includes (a) a sewing needle, (b) a first driver to reciprocate the needle, (c) a second driver to move the needle and a work sheet relative to each other in a direction crossing an axis line of the needle, and (d) a synchronizer to synchronize the reciprocation of the needle and the relative movement of the needle and work sheet, with each other, so as to form a series of stitches on the work sheet;

a detector connected to the sewing device to detect an abnormality of the sewing device;

a memory connected to the sewing device and the detector to store operation-state data indicative of an operation state of the sewing device upon detection of said abnormality; and utilizing means for utilizing the stored operation-state data for control of the sewing system, wherein the memory stores, as said operation-state data, abnormality-frequency data indicative of a frequency of occurrence of said abnormality per unit operation amount of the sewing device.

35. A sewing system comprising:

a sewing device which includes (a) a sewing needle, (b) a first driver to reciprocate the needle, (c) a second driver to move the needle and a work sheet relative to each other in a direction crossing an axis line of the needle, and (d) a synchronizer to synchronize the reciprocation of the needle and the relative movement of the needle and work sheet, with each other, so as to form a series of stitches on the work sheet;

a detector connected to the sewing device to detect an abnormality of the sewing device;

a memory connected to the sewing device and the detector to store operation-state data indicative of an operation state of the sewing device upon detection of said abnormality; and utilizing means for utilizing the stored operation-state data for control of the sewing system, wherein, each time the detector detects said abnormality during formation of said series of stitches, the memory stores, as said operation-state data, at least one set of operating-condition data indicative of at least one operating condition of the sewing device under which condition said abnormality has been detected by the detector, and thereby stores an accumulation of at least two sets of operating-condition data for at least two abnormalities that have occurred during formation of said series of stitches.

36. A sewing system comprising:

a sewing device which includes (a) a sewing needle, (b) a first driver to reciprocate the needle, (c) a second driver to move the needle and a work sheet relative to each other in a direction crossing an axis line of the needle, and (d) a synchronizer to synchronize the reciprocation of the needle and the relative movement of the needle and work sheet, with each other, so as to form a series of stitches on the work sheet;

a detector connected to the sewing device to detect an abnormality of the sewing device;

a memory connected to the sewing device and the detector to store operation-state data indicative of an operation state of the sewing device upon detection of said abnormality; and utilizing means for utilizing the stored operation-state data for control of the sewing system, wherein the sewing device forms said series of stitches in a predetermined sequence, the memory storing, as said operation-state data, stitch-location data indicative of a location in said predetermined sequence of a special one of said series of stitches which is being formed upon detection of said abnormality, the utilizing means utilizing said stitch-location data for modifying a control condition of the sewing device so as to form at least said special stitch under the modified control condition.

* * * * *